US009201365B2

(12) United States Patent
Sakashita et al.

(10) Patent No.: US 9,201,365 B2
(45) Date of Patent: Dec. 1, 2015

(54) IMAGE FORMING APPARATUS

(71) Applicants: Shingo Sakashita, Shizuoka (JP); Satoshi Kojima, Shizuoka (JP); Daisuke Misawa, Shizuoka (JP); Hiroshi Endoh, Shizuoka (JP); Tomoki Murayama, Kanagawa (JP); Rintaro Takahashi, Kanagawa (JP); Chihiro Kikuchi, Kanagawa (JP)

(72) Inventors: Shingo Sakashita, Shizuoka (JP); Satoshi Kojima, Shizuoka (JP); Daisuke Misawa, Shizuoka (JP); Hiroshi Endoh, Shizuoka (JP); Tomoki Murayama, Kanagawa (JP); Rintaro Takahashi, Kanagawa (JP); Chihiro Kikuchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/656,879

(22) Filed: Mar. 13, 2015

(65) Prior Publication Data

US 2015/0261144 A1 Sep. 17, 2015

(30) Foreign Application Priority Data

Mar. 17, 2014 (JP) ..... 2014-053942

(51) Int. Cl.
*G03G 15/20* (2006.01)

(52) U.S. Cl.
CPC ..... *G03G 15/206* (2013.01); *G03G 2215/2048* (2013.01)

(58) Field of Classification Search
CPC ..... G03G 15/2057; G03G 2215/2048; G03G 15/206
USPC ..... 399/333
See application file for complete search history.

(56) References Cited

FOREIGN PATENT DOCUMENTS

| | | |
|---|---|---|
| JP | 2012-083714 | 4/2012 |
| JP | 5237902 | 4/2013 |
| JP | 5273719 | 5/2013 |

*Primary Examiner* — David Bolduc
*Assistant Examiner* — Barnabas Fekete
(74) *Attorney, Agent, or Firm* — Oblon, McClelland, Maier & Neustadt, L.L.P.

(57) ABSTRACT

An image forming apparatus, including: photoconductor; charging unit; exposing unit; developing unit containing toner; transfer unit; and fixing unit, wherein the toner includes external additive and base particles containing binder resin, colorant, and release agent, the toner has melt viscosity at 100° C. of 500 Pa·s to 8,000 Pa·s and the release agent has melt viscosity at 100° C. of 20 mPa·s to 30 mPa·s, the fixing unit includes fixing member that has roller or belt shape and contacts toner image transferred onto recording medium, and the fixing member includes release layer on surface thereof that is to be brought into contact with the toner image transferred onto the recording medium, and wherein the release layer satisfies the following expressions:

$45 \leq \theta c1 \leq 60$, and $10 \leq \theta c1 - \theta c2$, where θc1 denotes receding contact angle [°] of the release agent to the release layer and θc2 denotes receding contact angle [°] of the release agent to the toner.

6 Claims, 6 Drawing Sheets

IMAGE FORMING APPARATUS

BACKGROUND OF THE INVENTION

1. Field of the Invention

The present invention relates to an image forming apparatus.

2. Description of the Related Art

In electrophotography, an electrostatic latent image is formed on a photoconductor, and developed with a charged toner conveyed by a developer bearer to form a toner image, which is then transferred onto recording media such as paper, and fixed with heating or the like to form an image. Meanwhile, the toner remaining on the photoconductor after the transfer of the toner image is recovered from the photoconductor by a cleaning member and discharged to a waste toner container.

Image forming apparatuses employing a heat-fixing system need much electricity in the process of heat-melting the toner to be fixed on recording medium such as paper. Hence, from the viewpoint of achieving energy saving, low temperature fixing ability is one important property.

Moreover, a higher level of gloss than conventional levels has recently been required in applications for commercial use, so-called production printing.

Furthermore, the printing speed of copiers has been keeping increasing. Particularly in production printing, there has been a significant increase in printing speed. In copiers, printed paper sheets need such separability as to avoid paper jam, but as the printing speed increases, a higher level of separability than conventional levels has been being required.

Japanese Patent Application Laid-Open (JP-A) No. 2012-83714 discloses a toner granulated by emulsifying or dispersing in an aqueous medium a toner material liquid containing toner materials dissolved or dispersed in an oily medium. Here, the toner contains hydrocarbon wax having a mass reduction at 165° C. of 10% by mass or less, and a binder resin. Further, the toner satisfies the following expression:

$$40 \geq \eta \times (W - 0.18) \geq 13$$

where $\eta$ denotes a complex viscosity (Pa·s) of the toner measured with a rheometer at a temperature at which tan $\delta$ of the toner shows a peak value in the range of from 140° C. to 200° C., and W denotes an amount of the wax that has oozed from the toner upon fixing at 170° C. (a ratio of the wax on the fixed image surface/binder resin).

SUMMARY OF THE INVENTION

However, it has been desired to prevent a gloss afterimage from being formed.

In view of the above problem pertinent in the art, it is an object in one aspect of the present invention to provide an image forming apparatus excellent in low temperature fixing ability and separability, and capable of preventing a gloss afterimage from being formed.

An image forming apparatus according to one aspect of the present invention includes: a photoconductor; a charging unit configured to charge the photoconductor; an exposing unit configured to expose the charged photoconductor to light to form an electrostatic latent image; a developing unit containing a toner and configured to develop the electrostatic latent image formed on the photoconductor with the toner to form a toner image; a transfer unit configured to transfer the toner image formed on the photoconductor onto a recording medium; and a fixing unit configured to fix the toner image transferred on the recording medium, wherein the toner includes an external additive and base particles containing a binder resin, a colorant, and a release agent, wherein the toner has a melt viscosity at 100° C. of 500 Pa·s to 8,000 Pa·s and the release agent has a melt viscosity at 100° C. of 20 mPa·s to 30 mPa·s, wherein the fixing unit includes a fixing member that has a roller shape or a belt shape and contacts the toner image transferred onto the recording medium, and the fixing member includes a release layer on a surface thereof that is to be brought into contact with the toner image transferred onto the recording medium, and wherein the release layer satisfies the following expressions:

$$45 \leq \theta c1 \leq 60, \text{ and}$$

$$10 \leq \theta c1 - \theta c2,$$

where $\theta c1$ denotes a receding contact angle [°] of the release agent with respect to the release layer and $\theta c2$ denotes a receding contact angle [°] of the release agent with respect to the toner.

According to one aspect of the present invention, it is possible to provide an image forming apparatus excellent in low temperature fixing ability and separability, and capable of preventing a gloss afterimage from being formed.

DETAILED DESCRIPTION OF THE INVENTION

Figure 1:
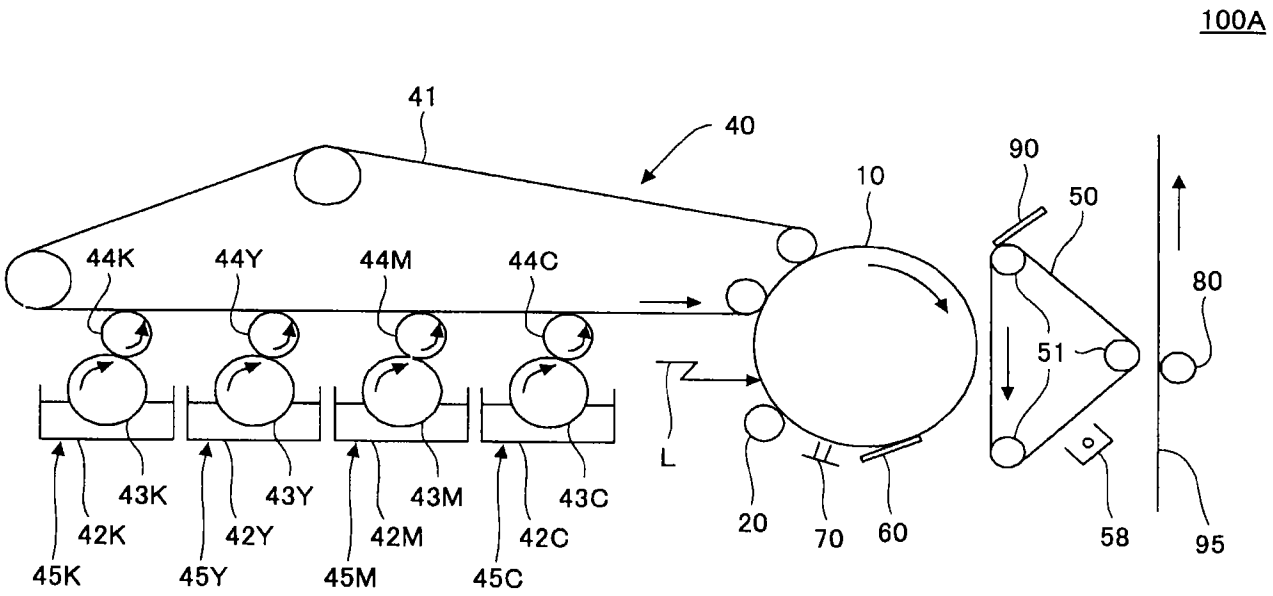
FIG. 1 is a schematic view of one example of an image forming apparatus.

Next, modes for carrying out the present invention will be described with reference to the drawings.

An image forming apparatus includes; a photoconductor; a charging unit configured to charge the photoconductor; an exposing unit configured to expose the charged photoconductor to light to form an electrostatic latent image; a developing unit containing a toner and configured to develop the electrostatic latent image formed on the photoconductor with the toner to form a toner image; a transfer unit configured to transfer the toner image formed on the photoconductor onto a recording medium; and a fixing unit configured to fix the toner image transferred on the recording medium.

A toner includes an external additive and base particles containing a binder resin, a colorant, and a release agent.

The toner has a melt viscosity at 100° C. of 500 Pa·s to 8,000 Pa·s. When the melt viscosity at 100° C. of the toner is less than 500 Pa·s, the melt viscosity of the toner is too low upon fixing, so that separability will be degraded. When it is more than 8,000 Pa·s, the melt viscosity of the toner is too high upon fixing, so that low temperature fixing ability will be degraded.

Note that, the melt viscosity at 100° C. of the toner can be measured using an elevated flow tester, model CFT500 (product of Shimadzu Corporation).

The melt viscosity at 100° C. of the toner can be controlled, for example by adjusting the amount of components insoluble in tetrahydrofuran and the amount of a crystalline polyester.

The melt viscosity at 100° C. of the release agent is 20 mPa·s to 30 mPa·s. When the melt viscosity at 100° C. of the release agent is less than 20 mPa·s, the release agent excessively oozes on the toner surface before the toner is melted upon fixing, resultant in degraded low temperature fixing ability and formation of gloss afterimages. Whereas when the melt viscosity at 100° C. of the release agent is more than 30 mPa·s, the release agent does not sufficiently oozes upon fixing, so that separability will be degraded.

The gloss afterimage is a phenomenon that the gloss of an image portion becomes higher patternwise of the previous image after the image portion has been fixed by contacting a fixing member having a release agent excessively remaining thereon when the release agent is oozed from a toner melted with heat upon fixing and the toner is separated from the fixing member. The gloss afterimage causes significant deterioration in image quality, and is critical particularly in production printing.

Note that, the melt viscosity at 100° C. of the release agent can be measured using DV-E viscometer (product of Brookfield Co.).

The melt viscosity at 100° C. of the release agent can be controlled by, foe example, adjusting the kind and the molecular weight of the release agent.

The fixing unit includes a fixing member that has a roller shape or a belt shape and contacts the toner image transferred onto the recording medium.

The fixing member includes a release layer on a surface thereof that is to be brought into contact with the toner image transferred onto the recording medium.

In the image forming apparatus, the release layer satisfies the following expressions:

$$45 \leq \theta c1 \leq 60, \text{ and}$$

$$10 \leq \theta c1 - \theta c2,$$

where θc1 denotes a receding contact angle [°] of the release agent with respect to the release layer and θc2 denotes a receding contact angle [°] of the release agent with respect to the toner. When the θc1 is less than 45°, a large amount of the release agent remains on the fixing member after separation following fixing, which causes gloss afterimage. When it is more than 60°, separability will decrease. Meanwhile, the θc1-θc2 is less than 10°, it becomes difficult for the release agent remain on the surface of the toner image after separation following fixing, which causes gloss afterimage.

Note that, the θc1 and θc2 can be measured using contact angle measuring device Drop Master DM500 (product of Kyowa Interface Science Co., LTD.).

The material for forming the release layer is not particularly limited but examples thereof include fluorine resins such as PFA and ETFE.

The base particles contain a binder resin, a colorant, and a release agent; and if necessary, may further contain a charge-controlling agent, a layered inorganic mineral, and the like.

The binder resin is not particularly limited but examples thereof include polyesters, silicone resins, styrene/acrylic resins, styrene resins, acrylic resins, epoxy resins, diene-based resins, phenol resins, terpene resins, coumarin resins, amideimide resins, butyral resins, urethane resins, and ethylene-vinyl acetate resins. These may be used alone or in combination of two or more kinds thereof. Among them, polyesters are preferred since they are excellent in low temperature fixing ability, can smooth the surface of an image, and has sufficient flexibility even if lowered in molecular weight.

The polyesters are not particularly limited but examples thereof include non-crystalline polyesters, crystalline polyesters, and modified polyesters. These may be used alone or in combination of two or more kinds thereof.

Unmodified polyesters can be synthesized through polycondensation between polyols represented by General Formula (1) below and polycarboxylic acids represented by General Formula (2) below:

$$A\text{-}[OH]m \quad (1)$$

(where A denotes an alkyl group having 1 to 20 carbon atoms, an alkylene group, or an optionally substituted aromatic group or heteroaromatic group, and m is an integer of 2 to 4); and $$B\text{—}[COOH]n \quad (2)$$

(where B denotes an alkyl group having 1 to 20 carbon atoms, an alkylene group, or an optionally substituted aromatic group or heteroaromatic group, and n is an integer of 2 to 4).

The polyols represented by General Formula (1) are not particularly limited but examples thereof include ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene, bisphenol A, ethylene oxide adduct of bisphenol A, propylene oxide adduct of bisphenol A, hydrogenated bisphenol A, ethylene oxide adduct of hydrogenated bisphenol A, propylene oxide adduct of hydrogenated bisphenol A. These may be used alone or in combination of two or more kinds thereof.

The polycarboxylic acids represented by General Formula (2) are not particularly limited but examples thereof include maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenylsuccinic acid, isooctyl succinic acid, isododecenyl succinic acid, n-dodecyl succinic acid, isododecyl succinic acid, n-octenyl succinic acid, n-octyl succinic acid, isooctenyl succinic acid, isooctyl succinic acid, 1,2,4-benzene tricarboxylic acid, 2,5,7-naphthalene tricarboxylic acid, 1,2,4-naphthalene tricarboxylic acid, 1,2,4-butane tricarboxylic acid, 1,2,5-hexane tricarboxylic acid, 1,3-dicarboxyl-2-methyl-2-methylene carboxy propane, 1,2,4-cyclohexane tricarboxylic acid, tetra(methylenecarboxyl) methane, 1,2,7,8-octane tetracarboxylic acid, pyromellitic acid, Empol trimer acid, cyclohexanedicarboxylic acid, cyclohexene dicarboxylic acid, butane tetracarboxylic acid, diphenylsulphone; tetracarboxylic acid, ethylene glycol bis (trimellitic acid). These may be used alone or in combination of two or more kinds thereof.

The crystalline polyester can be synthesized by polycondensation of an alcohol component and an acid component.

The alcohol component is not particularly limited but examples thereof include saturated aliphatic diols having 2 to 12 carbon atoms (e.g., 1,4-butanediol, 1,6-hexanediol, 1,8-octanediol, 1,10-decanediol, and 1,12-dodecanediol) and derivatives thereof.

The acid component is not particularly limited but examples thereof include dicarboxylic acids having carbon-carbon double bond and having 2 to 12 carbon atoms (e.g., fumaric acid); saturated dicarboxylic acids having 2 to 12 carbon atoms (e.g., 1,4-butanedioic acid, 1,6-hexanedioic acid, 1,8-octanedioic acid, 1,10-decanedioic acid, and 1,12-dodecanedioic acid) and derivatives thereof.

In order to reduce a difference between an endothermic peak temperature and an endothermic shoulder temperature, the crystalline polyester is preferably synthesized by polycondensation between 1,4-butanediol, 1,6-hexanediol, 1,8-octanediol, 1,10-decanediol, or 1,12-dodecanediol, and fumaric acid, 1,4-butanedioic acid, 1,6-hexanedioic acid, 1,8-octanedioic acid, 1,10-decanedioic acid or 1,12-dodecanedioic acid.

A method for controlling crystallinity and softening point of the crystalline polyester is not particularly limited but examples thereof include a method by addition of trihydric or higher polyhydric alcohol such as glycerin or trivalent or higher polyvalent carboxylic acid such as trimellitic anhydride during polycondensation thereof.

A molecular structure of the crystalline polyester can be confirmed by solution-state or solid-state NMR, X-ray diffraction, GC/MS, LC/MS, or IR spectroscopy.

An amount of the crystalline polyester in the toner is generally 3% by mass to 15% by mass, preferably 5% by mass to 10% by mass. When the amount of the crystalline polyester in the toner is 3% by mass or more, the resultant toner can be improved in low temperature fixing ability. Meanwhile, when the amount of the crystalline polyester in the toner is 15% by mass or less, the resultant toner can be improved in heat resistant storage stability.

A ratio of a softening temperature of the crystalline polyester to a melting point thereof is generally 0.80 to 1.55. In this case, the crystalline polyester can sharply be softened by heat.

Note that, the softening temperature of the crystalline polyester can be measured using an elevated flow tester.

Also, the melting point of the crystalline polyester can be measured by a differential scanning calorimetry (DSC).

The modified polyester can be synthesized by reacting an active hydrogen group-containing compound with a polyester prepolymer containing a group reactive with the active hydrogen group.

The active hydrogen group-containing compound serves as an elongation agent and a cross-linking agent.

The active hydrogen group is not particularly limited but examples thereof include an hydroxyl group (alcoholic hydroxy group or phenolic hydroxy group), an amino group, a carboxyl group, and a mercapto group. These may be used in combination of two or more kinds thereof. Among them, when a group reactive with the active hydrogen group is an isocyanate group, an amino group is preferable as the active hydrogen group, because it can increase a molecular weight.

The compound containing the amino group is not particularly limited but examples thereof include diamine, trivalent or higher polyamine, aminoalcohol, aminomercaptan, and an amino acid. These may be used in combination of two or more kinds thereof. Among them, diamine and a mixture of diamine and a small amount of trivalent or higher polyamine are preferable.

Examples of the diamine include aromatic diamines (e.g., phenylenediamine, diethyltoluenediamine and 4,4'-diaminodiphenylmethane), alicyclic diamines (e.g., 4,4'-diamino-3,3'-dimethyldicyclohexylmethane, diaminocyclohexane and isophoronediamine); and aliphatic diamines (e.g., ethylenediamine, tetramethylenediamine and hexamethylenediamine).

Examples of the trivalent or higher polyamine include diethylenetriamine and triethylenetetramine.

Examples of the amino alcohol include ethanolamine and hydroxyethylaniline.

Examples of the aminomercaptan include aminoethyl mercaptan and aminopropyl mercaptan.

Examples of the amino acid include aminopropionic acid and aminocaproic acid.

Instead of the amino acid-containing compound, a blocked-amino group-containing compound may be used.

The blocked-amino group-containing compound is not particularly limited but examples thereof include ketimine and oxazolidine synthesized by reacting the amino acid-containing compound with ketone (e.g., acetone, methyl ethyl ketone and methyl isobutyl ketone).

A polymer containing a group reactive with the active hydrogen is not particularly limited but examples thereof include an isocyanate group-containing polyester prepolymer, because it is excellent in high fluidity and transparency during melting, can easily adjust a molecular weight of the macromolecular component, and is excellent in oil-less low temperature fixing ability and releasability in a dry type toner.

The isocyanate group-containing polyester prepolymer can be obtained by synthesizing a polyester having a hydroxyl group by polycondensation of polyol and polycarboxylic acid, and then, by reacting the polyester having a hydroxyl group with polyisocyanate.

The polyol is not particularly limited but examples thereof include alkylene glycols (e.g., ethylene glycol, 1,2-propylene glycol, 1,3-propylene glycol, 1,4-butanediol, and 1,6-hexanediol), alkylene ether glycols (e.g., diethylene glycol, triethylene glycol, dipropylene glycol, polyethylene glycol, polypropylene glycol, and polytetramethylene ether glycol), alicyclic diols (e.g., 1,4-cyclohexanedimethanol and hydrogenated bisphenol A), bisphenols (e.g., bisphenol A, bisphenol F, and bisphenol S), alkylene oxide adducts of alicyclic diol (e.g., ethylene oxide, propylene oxide, and butylene oxide), and alkylene oxide adducts of bisphenols (e.g., ethylene oxide, propylene oxide, and butylene oxide); and trihydric or higher polyols such as multivalent aliphatic alcohols (e.g., grycerin, trimethylolethane, trimethylolpropane, pentaerythritol, and sorbitol), trihydric or higher phenols (e.g., phenol novolak and cresol novolak), and alkylene oxide adducts of trihydric or higher polyphenols. These may be used alone or in combination of two or more kinds thereof. In particular, diols and mixtures of diols and a small amount of trihydric or higher polyols.

The diol is preferably C2-C12 alkylene glycols, and alkylene oxide adducts of bisphenols (e.g., bisphenol A ethylene oxide 2 mole adducts, bisphenol A propylene oxide 2 mole adducts, and bisphenol A propylene oxide 3 mole adducts).

An amount of the constituent unit derived from polyol in the isocyanate group-containing polyester prepolymer is generally 0.5% by mass to 40% by mass, preferably 1% by mass to 30% by mass, more preferably 2% by mass to 20% by mass. When the amount thereof is less than 0.5%, the resultant toner may be deteriorated in hot offset resistance. When the amount thereof is more than 40% by mass, the resultant toner may be deteriorated in low temperature fixing ability.

The polycarboxylic acid is not particularly limited but examples thereof include alkylene dicarboxylic acids (e.g., succinic acid, adipic acid, and sebacic acid), alkenylene dicarboxylic acids (e.g. maleic acid and fumaric acid), aromatic dicarboxylic acids (e.g., terephthalic acid, isophthalic acid, and naphthalene dicarboxylic acid), and trivalent or higher polycarboxylic acid (e.g., aromatic polycarboxylic acids having 9 to 20 carbon atoms such as trimellitic acid and pyromellitic acid). These may be used alone or in combination of two or more kinds thereof. Among them, an alkenylene dicarboxylic acid having 4 to 20 carbon atoms, and an aromatic dicarboxylic acid having 8 to 20 carbon atoms are preferable.

Note that, instead of the polycarboxylic acid, anhydrides of the polycarboxylic acid, and lower alkyl esters (e.g., methyl ester, ethyl ester, and isopropyl ester) may be used.

During polycondensation of polyol with polycarboxylic acid, a ratio by mole of hydroxyl group in polyol to carboxyl group in polycarboxylic acid [OH]/[COOH] is generally 1 to 2, preferably 1 to 1.5, more preferably 1.02 to 1.3.

A method for polycondensation of polyol and polycarboxylic acid is not particularly limited but examples thereof include a method of heating them in the presence of an esterification catalyst (e.g., titanium tetrabutoxide and dibutyltin oxide) to 150° C. to 280° C., and then removing produced water with reducing pressure, if necessary.

—Polyisocyanate—

Polyisocyanate is not particularly limited but examples thereof include (e.g., tetramethylene diisocyanate, hexamethylene diisocyanate, 2,6-diisocyanato methyl caproate, octamethylene diisocyanate, decamethylene diisocyanate, dodecamethylene diisocyanate, tetradecamethylene diisocyanate, trimethylhexane diisocyanate, and tetramethylhexane diisocyanate); alicyclic polyisocyanates (e.g., isophorone diisocyanate and cyclohexylmethane diisocyanate); aromatic diisocyanates (e.g., tolylene diisocyanate, diphenylmethane diisocyanate, 1,5-naphthylene diisocyanate, diphenylene 4,4'-diisocyanate, 4,4'-diisocyanato 3,3'-dimethylphenyl, 3-methyldiphenylmethane-4,4'-diisocyanate, diphenyl ether 4,4'-diisocyanate); aromatic aliphatic diisocyanates (e.g., α,α,α',α'-tetramethyl xylylene diisocyanate); and isocyanurates (e.g., trigisocyanatoalkyl)isocyanurate, tris(isocyanatocycloalkyl)isocyanurate). These may be used alone or in combination of two or more kinds thereof.

Note that, instead of the afforementioned polyisocyanate, polyisocyanate where an isocyanate group blocked by phenol derivative of polyisocyanate, oxime, or caprolactam is blocked, may be used.

During reacting the polyester having a hydroxyl group and polyisocyanate, a ratio by mole of isocyanate group in polyisocyanate to hydroxy group in the polyester having a hydroxyl group [NCO]/[OH] is generally 1 to 5, preferably 1.2 to 4, more preferably 1.5 to 3. When the [NCO]/[OH] is less than 1, the resultant toner may be deteriorated in offset resistance. When the [NCO]/[OH] is more than 5, the resultant toner may be deteriorated in low temperature fixing ability.

A method for reacting the hydroxyl group containing polyester with polyisocyanate is not particularly limited but examples thereof include a method for reacting the hydroxyl group containing polyester with polyisocyanate to 40° C. to 140° C.

An amount of the constituent unit derived from polyisocyanate in the isocyanate group-containing polyester prepolymer is generally 0.5% by mass to 40% by mass, preferably 1% by mass to 30% by mass, more preferably 2% by mass to 20% by mass. When the amount thereof is less than 0.5% by mass, the resultant toner may be deteriorated in hot offset resistance. When the amount thereof is more than 40% by mass, the resultant toner may be deteriorated in low temperature fixing ability.

An average value of the number of isocyanate group in the isocyanate group-containing polyester prepolymer is generally 1 or more, preferably 1.2 to 5, more preferably 1.5 to 4. When the average value thereof is less than 1, the resultant toner may be deteriorated in hot offset resistance.

A weight average molecular weight of the isocyanate group-containing polyester prepolymer is generally 3,000 to 40,000, preferably 4,000 to 30,000. When the weight average molecular weight thereof is less than 3,000, the resultant toner may be deteriorated in heat resistant storage stability. When the weight average molecular weight thereof is more than 40,000, the resultant toner may be deteriorated in low temperature fixing ability.

Note that, the weight average molecular weight of the isocyanate group-containing polyester prepolymer is a molecular weight obtained by converting it to polystyrene as measured by gel permeation chromatography (GPC).

When the isocyanate group-containing polyester prepolymer is reacted with the amino acid-containing compound, a ratio by mole of isocyanate group [NCO] to amino group [NHx], [NCO]/[NHx] is generally ⅓ to 3, preferably ½ to 2, more preferably ⅔ to 1.5. When the [NCO]/[NHx] is less than ⅓, the resultant toner may be deteriorated in low temperature fixing ability. When the [NCO]/[NHx] is more than 3, the resultant toner may be deteriorated in hot offset resistance.

When the isocyanate group-containing polyester prepolymer is reacted with the amino acid-containing compound, the reaction may be terminated by a reaction terminator.

The reaction terminator is not particularly limited but examples thereof include monoamines such as diethylamine, dibutyl amine, butyl amine, and lauryl amine; and ketimine compounds where an amino group in monoamine is blocked.

The release agent is not particularly limited but examples thereof include waxes such as vegetable wax (e.g., carnauba wax, cotton wax, Japan wax and rice wax), animal wax (e.g., bees wax and lanolin), mineral wax (e.g., ozokelite and ceresine), and petroleum wax (e.g., paraffin wax, microcrystalline wax and petrolatum); waxes other than the above natural wax and synthetic hydrocarbon wax (e.g., Fischer-Tropsch wax and polyethylene wax) and synthetic wax (e.g., ester wax, ketone wax and ether wax); and aliphatic acid amides such as 1,2-hydroxy stearic acid amide, stearic acid amide, phthalic imide anhydride, chlorinated hydrocarbon. Among them, Fischer-Tropsch wax, paraffin wax, microcrystalline wax, monoester wax, and rice wax are preferable because these slightly generate unnecessary volatile organic compounds during fixing.

Examples of the commercially available products of microcrystalline wax, HI-MIC-1045, HI-MIC-1070, HI-MIC-1080, HI-MIC-1090 (these products are of NIPPON SEIRO Co.), BE SQUARE 180 WHITE, BE SQUARE 195 (these products are of TOYO ADL CORPORATION), BARECO C-1035 (product of WAX Petrolife), and CRAYVALLAC WN-1442 (product of Cray Vally).

An onset temperature of the endothermic peak at the lowest temperature side in differential scanning calorimetry analysis of the release agent is generally 50° C. or more, preferably 55° C. or more, more preferably 60° C. or more. When the onset temperature thereof is 50° C. or more, the release agent may be inhibited from oozing from the resultant toner at a temperature of about 30° C. to about 50° C., which may lead to improvement in heat resistant storage stability.

Note that, in the endothermic peak at the lowest temperature side measured in second heating, its onset temperature is at a temperature corresponding to a point of intersection between a tangent line where the gradient of a curve is the largest (point of inflection) and an extended line of the base line.

A melting point of the release agent is generally 60° C. to 100° C., preferably 65° C. to 90° C. When the melting point thereof is 60° C. or more, the resultant toner may be improved in heat resistant storage stability. Meanwhile, the melting point thereof is 100° C. or more, the resultant toner may be improved in low temperature fixing ability.

The melting point is a temperature corresponding to the peak top of the endothermic peak measured in second heating.

Note that, the onset temperature and the melting point can be measured by TA-60WS and DSC-60 (products of SHIMADZU CORPORATION).

The release agent preferably exists in a dispersion state in base particles. Accordingly, the release agent is preferably incompatible with the binder resin.

A method for dispersing the release agent in the base particles is not particularly limited but examples thereof include a method for dispersing the release agent by applying shear force during producing a toner.

An amount of the release agent in the toner is generally 3% by mass to 15% by mass, preferably 5% by mass to 10% by mass. When the amount thereof is less than 3% by mass, the resultant toner may be deteriorated in hot offset resistance. When the amount thereof is more than 15% by mass, the release agent may excessively ooze, which may cause gloss afterimage.

A release agent dispersing resin is preferably used in order to control dispersion state/existing state of the release agent in the base particles.

The release agent dispersing resin is not particularly limited but examples thereof include graft polymer made of an olefin resin and a graft polymer.

The graft polymer has a structure containing a main chain made of the olefin resin and the vinyl resin grafted from the main chain.

The graft polymer can be synthesized by dissolving the olefin resin in an organic solvent, and then by graft polymerization in the presence of a polymerization inhibitor such as organic peroxides.

A mass ratio of olefine resin to vinyl monomer is generally 1 to 30:70 to 99, preferably 5 to 25:75 to 95 from the viewpoint of filming resistance.

The graft polymer may contain an unreacted olefin resin and a homopolymer of vinyl monomer.

An amount of the unreacted olefin resin in the graft polymer is generally 5% by mass or less, preferably 3% by mass or less.

An amount of the homopolymer of vinyl monomer in the graft polymer is generally 10% by mass or less, preferably 5% by mass or less.

A purity of the graft polymer is generally 85% by mass or more, preferably 90% by mass or more.

A purity and a molecular weight of the graft polymer and a molecular weight of the vinyl resin can be controlled under the condition of a ratio of materials charged, a polymerization temperature, and a polymerization time.

An olefin forming olefin resin is not particularly limited but examples thereof include ethylene, propylene, 1-butene, isobutylene, 1-hexene, 1-dodecene, and 1-octadecen.

Examples of the olefin resin include an olefin polymer and thermally decomposed products, oxides, modified products thereof, and copolymers of olefin and another monomer.

The olefin polymer is not particularly limited but examples thereof include polyethylene, polypropyrene, ethylene/propylene copolymer, ethylene/1-butene copolymer, and propylene/1-hexene copolymer.

The thermally decomposed product of the olefin polymer can be synthesized by heating an olefin polymer having a weight average molecular weight of $5\times10^4$ to $5\times10^6$ to 250° C. to 450° C., to thereby reduce a molecular weight.

The thermally decomposed product of the olefin polymer preferably contains double bonds at a rate of 30% to 70% per one molecule thereof, where the rate of the double bonds corresponds to the number of molecules calculated from the number average molecular weight.

The modified products of olefin polymers are not particularly limited but examples thereof include maleic acid derivatives (e.g., maleic anhydride, monomethyl maleate, monobutyl maleate, and dimethyl maleate) adducts of olefin polymers.

Another monomer in copolymers of olefin and another monomer is not particularly limited but examples thereof include unsaturated carboxylic acid (e.g., (meth)acrylic acid, itaconic acid, and maleic anhydride), alkyl esters of unsaturated carboxylic acids (e.g., (meth)acrylic acid alkyl esters having 1 to 18 carbon atoms, and maleic acid alkyl esters having 1 to 18 carbon atoms).

A monomer in the olefin resin may not contain an olefin structure, and thus the olefin resin also contains polymethylenes such as SASOL wax.

A softening point of the olefin resin is generally 60° C. to 170° C. in order to improve flowability of the toner. The softening point thereof is preferably 70° C. to 150° C., more preferably 70° C. to 130° C., in order to exhibit effective releasing effects.

From the viewpoints of releasing ability and filming on a carrier and the like, a number average molecular weight of the olefin resin is generally 500 to 20,000, preferably 1,000 to 15,000, more preferably 1,500 to 10,000.

From the same viewpoints, a weight average molecular weight of the olefin resin is generally 800 to 100,000, preferably 1,500 to 60,000, more preferably 2,000 to 30,000.

The vinyl monomer is not particularly limited but examples thereof include styrene monomers (e.g., styrene, α-methylstyrene, p-methylstyrene, m-methylstyrene, p-methoxystyrene, p-hydroxystyrene, p-acetoxystyrene, ethylstyrene, phenylstyrene, and benzylstyrene), C1-C18 alkyl esters of unsaturated carboxylic acids (e.g., methyl (meth) acrylate, ethyl (meth)acrylate, butyl (meth)acrylate, and 2-ethylhexyl (meth)acrylate), vinyl ester monomers (e.g., vinyl acetate), vinyl ether monomers (e.g., vinyl methyl ether), vinyl monomers containing halogen groups (e.g., vinyl chloride), diene monomers (e.g., butadiene and isobutylene), (meth)acrylonitrile, and unsaturated nitrile monomers (e.g., cyanostyrene). These may be used alone or in combination of two or more kinds thereof. In particular, styrene monomers, unsaturated carboxylic acid alkyl esters, (meth)acrylonitrile, and any combination thereof are preferable, and styrene and combinations of styrene and (meth) acrylic acid alkyl esters or (meth)acrylonitrile are more preferable.

A number average molecular weight of the vinyl resin is generally 1,500 to 100,000, preferably 2,500 to 50,000, more preferably 2,800 to 20,000.

A weight average molecular weight of the vinyl resin is generally 5,000 to 200,000, preferably 6,000 to 100,000, more preferably 7,000 to 50,000.

From the viewpoint of improvements in storage stability and low temperature fixing ability, a glass transition temperature of the vinyl resin is generally 50° C. to 80° C., preferably 55° C. to 70° C.

Specific examples of the graft polymer include the following combinations of olefin resin (R) and vinyl resin (S).

(R): polyethylene; (S): styrene/acrylonitrile/butyl acrylate copolymer (R): polyethylene; (S): styrene/acrylonitrile/butyl acrylate/acrylic acid copolymer (R): polypropylene; (S): styrene/acrylonitrile/butyl acrylate copolymer (R): polypropylene; (S): styrene/acrylonitrile/butyl acrylate/acrylic acid copolymer (R): polypropylene; (S): styrene/acrylonitrile/butyl acrylate/monobutyl maleate copolymer (R): oxidized polypropylene; (S): styrene/acrylonitrile copolymer (R): polyethylene/polypropylene mixture; (S): styrene/acrylonitrile copolymer (R): ethylene/propylene copolymer; (S): styrene/acrylic acid/butyl acrylate copolymer (R): ethylene/propylene copolymer; (S): styrene/acrylonitrile/butyl acrylate copolymer (R): maleic acid modified polypropylene; (S): styrene/acrylonitrile/acrylic acid/butyl acrylate copolymer (R): maleic acid modified polypropylene; (S): styrene/acrylonitrile/acrylic acid/2-ethylhexyl acrylate copolymer (R): polyethylene/maleic acid modified polypropylene mixture; (S): acrylonitrile/butyl acrylate/styrene/monobutyl maleate copolymer The graft polymer can be synthesized as follows. Specifically, the olefin resin is dissolved or dispersed in a solvent (e.g., toluene or xylene). The resultant dispersion or solution is heated to 100° C. to 200° C. Thereafter, the vinyl monomer is added dropwise thereto with a peroxide initiator to perform polymerization.

The peroxide initiator is not particularly limited but examples thereof include benzoylperoxide, di-t-butylperoxide, di-t-butylperoxyhexahydro terephthalate, and t-butylperoxide benzoate.

A mass ratio of the peroxide initiator to the vinyl monomer is generally 0.002 to 0.1, preferably 0.005 to 0.05.

From the viewpoint of dispersion stability of the release agent, a mass ratio of the graft polymer to the release agent is generally 0.3 to 1.2, preferably 0.35 to 1.

A color of the colorant include is not particularly limited but examples thereof include black, cyan, magenta, and yellow.

A colorant for black is not particularly limited but examples thereof include carbon black (C.I. Pigment Black 7) such as furnace black, lamp black, acetylene black, and channel black, in organic pigments such as copper, iron (C.I. Pigment Black 11), and titanium oxide, and organic pigments such as aniline black (C.I. Pigment Black 1).

A colorant for magenta is not particularly limited but examples thereof include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48:1, 49, 50, 51, 52, 53, 53:1, 54, 55, 57, 57:1, 58, 60, 63, 64, 68, 81, 83, 87, 88, 89, 90, 112, 114, 122, 123, 150, 163, 177, 179, 184, 202, 206, 207, 209, 211, 269; C.I. Pigment Violet 19; C.I. Vat Red 1, 2, 10, 13, 15, 23, 29, and 35.

A colorant for cyan is not particularly limited but examples thereof include C.I. Pigment Blue 2, 3, 15, 15:1, 15:2, 15:3, 15:4, 15:6, 16, 17, 60; C.I. Vat Blue 6; C.I. Acid Blue 45, copper phthalocyanine pigments whose phthalocyanine skeleton has 1 to 5 phthalimidemethyl groups as substituents, Green 7, and Green 36.

A colorant for yellow is not particularly limited but examples thereof include C.I. Pigment Yellow 1, 2, 3, 4, 5, 6, 7, 10, 11, 12, 13, 14, 15, 16, 17, 23, 55, 65, 73, 74, 83, 97, 110, 139, 151, 154, 155, 180, 185; C.I. Vat Yellow 1, 3, 20, and Orange 36.

An amount of the colorant in the toner is generally 1% by mass to 15% by mass, more preferably 3% by mass to 10% by mass. When the amount of the colorant in the toner is less than 1% by mass, coloring ability of the resultant toner may be degraded. When it is more than 15% by mass, the colorant causes dispersion failure in the toner, which may lead to degradation in coloring ability and electrical properties of the resultant toner.

The colorant may be used as a masterbatch obtained by forming a composite with a resin.

The resin used is not particularly limited but is preferably a binder resin or a resin having a similar structure to the binder resin from the viewpoints of compatibility with the binder resin.

The masterbatch can be prepared by mixing and kneading the resin and the colorant together with the application of high shearing force. In the mixing and kneading, an organic solvent is preferably added for improving interactions between the colorant and the resin. Alternatively, a flashing method can also be employed for producing the masterbatch. This method is preferable because a wet cake of the colorant is used as it is without drying. The flashing method is a method in which an aqueous paste of the colorant is mixed and kneaded with the resin and the organic solvent to transfer the colorant to the resin, and then the water and the organic solvent are removed.

A device for applying high shearing force is not particularly limited but may be a high-shearing disperser such as a three-roll mill).

The charge-controlling agent is not particularly limited but examples thereof include triphenylmethane dyes, molybdic acid chelate pigments, rhodamine dyes, alkoxyamines, quaternary ammonium salts (including fluorine-modified quaternary ammonium salts), alkylamides, phosphorus, and phosphorus compounds, tungsten, tungsten compounds, fluorine-containing surfactants, metal salts of salicylic acid, and metal salts of salicylic acid derivatives. These may be used alone or in combination of two or more kinds thereof.

A mass ratio of the charge-controlling agent to the binder resin generally 0.0001 to 0.05, preferably 0.0002 to 0.02. When the mass ratio of the charge-controlling agent to the binder resin is less than 0.0001, the resultant toner is insufficient in charge rising property and charge amount, which may adversely affect toner images. When it is more than 0.05, the toner is excessively large in chargeability to increase electrostatic attractive force between the resultant toner and a developing roller, so that a developer containing it may be degraded in flowability and image density may be degraded.

The layered inorganic mineral is not particularly limited so long as it is an inorganic mineral containing several nanometers-thick layers stacked. Examples thereof include montmorillonite, bentonite, hectorite, attapulgite, sepiolite. These may be used alone or in combination of two or more kinds thereof. In particular, a modified layered inorganic mineral is preferable since it can make shapes of toner particles indefinite during granulation, can achieve charge adjusting functions, and is excellent in low temperature fixing ability. More preferable is a modified layered inorganic mineral that is a layered inorganic mineral having a basic crystal structure of montmorillonite and modified with an organic cation. Particularly preferable are organic modified montmorillonite and bentonite since they do not adversely affect properties of the resultant toner and allows for easy adjustment of viscosity.

In the modified layered inorganic mineral, at least part of cations of its layered inorganic mineral are preferably modified with organic ions. The modified layered inorganic mineral modified in this manner makes it possible to make shapes of toner particles indefinite when the toner particles are produced by the ester extension method or the dissolution suspension method.

An amount of the layered inorganic mineral in the toner is generally 0.05% by mass to 5% by mass.

The external additive preferably contains inorganic particles having a number average particle diameter of 30 nm to 60 nm, more preferably contains inorganic particles having a number average particle diameter of 30 nm to 50 nm. The above-described external additive improves flowability of the toner, is prevented from being buried in the base particles due to external stress applied over time, and can prevent formation of abnormal images due to aggregation of the toner particles.

The external additive preferably contains inorganic particles having a number average particle diameter of 80 nm to 200 nm, more preferably contains inorganic particles having a number average particle diameter of 100 nm to 180 nm. The above-described external is prevented from being buried in the base particles due to external stress applied over time, and can prevent formation of abnormal images due to aggregation of the toner particles.

The inorganic particles are not particularly limited but examples thereof include silica particles, hydrophobized silica particles, titania particles, hydrophobized titania particles, alumina particles, hydrophobized alumina particles, tin oxide particles, hydrophobized tin oxide particles, antimony oxide particles, and hydrophobized antimony oxide particles. Among them, hydrophobized silica particles, titania particles, and hydrophobized titania particles are preferable.

Examples of commercially available products of the hydrophobized silica particles include HDK H2000T, HDK H2000/4, HDK H2050EP, HVK21, and HDK H1303VP (these products are of Clariant Japan, Co.) and R972, R974, RX200, RY200, R202, R805, R812, and NX90G (these products are of Nippon Aerosil Co.).

Examples of commercially available products of the titania particles include P-25 (product of Nippon Aerosil Co.); STT-30 and STT-65 C-S (both products are of Titan Kogyo, Co.); TAF-140 (product of Fuji Titanium Industry Co.); and MT-150W, MT-500B, MT-600 B, MT-150A (these products are of TAYCA CORPORATION).

Examples of commercially available products of the hydrophobized titanium oxide particles include T-805 (product of Nippon Aerosil Co.); STT-30A and STT-65S-S (both products are of Titan Kogyo, Co.); TAF-500T and TAF-1500T (both products are of Fuji Titanium Industry Co.); MT-100S and MT-100T (both products are of TAYCA CORPORATION); and IT-S (product of ISHIHARA SANGYO KAISHA).

Examples of the other external additives than inorganic particles include fatty acid metal salts (e.g., zinc stearate and aluminium stearate) and fluoropolymers.

A mass ratio of the external additive to the base particles is generally 0.003 to 0.03, preferably 0.005 to 0.02.

A coverage rate of the base particles with the external additive is generally 50% to 90%, preferably 60% to 80%.

A production method for the toner is not particularly limited but examples thereof include a pulverization method, and a chemical method in which base particles are granulated in an aqueous medium.

Examples of the chemical method include a suspension polymerization method, an emulsion polymerization method, a seed polymerization method, a dispersion polymerization method, a dissolution suspension method, an ester extension method, an inverse emulsification method, and an emulsification aggregation method. Among them, from the viewpoint of granularity (e.g., control of particle size distribution, and control of particle shape), a dissolution suspension method, an ester extension method, and an emulsification aggregation method are preferable, and an ester extension method is more preferable.

Hereinafter, these production methods for the toner will be described in detail.

The pulverization method is a method for producing toner base particles by melt-kneading a composition containing a binder resin, a colorant, and a release agent, followed by pulverizing and classifying.

A melt-kneader for melt-kneading the composition is not particularly limited but may be, for example, a single-screw or twin-screw continuous kneader, or a batch-type kneader with a roll mill.

Examples of commercially available products of the melt-kneader include a KTT type twin screw extruder (product of KOBE STEEL, Co.), a TEM type extruder (product of TOSHIBA MACHINE Co.), a twin screw extruder (product of KCK Engineering Co.), a PCM type twin screw extruder (product of Ikegai Co.), and a co-kneader (product of Buss Co.).

In pulverizing the kneaded product, it is preferable that the kneaded product be coarsely pulverized and then finely pulverized.

A method for pulverizing the kneaded product is not particularly limited but examples thereof include a method in which the kneaded product is pulverized by making the kneaded product to crush into an impact plate in the jet stream, a method in which the kneaded product is pulverized by making particles of the kneaded product to crush with each other in the jet stream, and a method in which the kneaded product is pulverized in a narrow gap between a mechanically rotating rotor and a stator.

A device for classifying the pulverized product is not particularly limited but examples thereof include a cyclone, a decanter, or a centrifugal separator.

The dissolution suspension method is a method for producing base particles by dispersing or emulsifying, in an aqueous phase, an oil phase containing a binder resin and/or a precursor of the binder resin, a colorant, and a release agent dissolved or dispersed in an organic solvent, followed by removing the organic solvent.

The precursor of the binder resin is not particularly limited but may be a polymer containing a group reactive with an active hydrogen group.

The organic solvent preferably has a boiling point of lower than 100° C. since it can be easily removed.

The organic solvent is not particularly limited but examples thereof include ester solvents or ester ether solvents such as ethyl acetate, butyl acetate, methoxybutyl acetate, methyl cellosolve acetate, and ethyl cellosolve acetate; ether solvents such as diethyl ether, tetrahydrofuran, dioxane, ethyl cellosolve, butyl cellosolve, propylene glycol monomethyl ether; ketone solvents such as acetone, methyl ethyl ketone, methyl isobutyl ketone, di-n-butyl ketone, and cyclohexanone; alcohol solvents such as methanol, ethanol, n-propanol, isopropanol, n-butanol, isobutanol, t-butanol, 2-ethylhexyl alcohol, and benzyl alcohol. These may be used alone or in combination of two or more kinds thereof.

In dispersing or emulsifying the oil phase in the aqueous phase, a emulsifier or dispersant may be used, if necessary.

The emulsifier or dispersant usable is, for example, a surfactant or a water-soluble polymer.

The surfactant is not particularly limited but examples thereof include anionic surfactants (e.g., alkylbenzene sulfonate and phosphoric acid esters), cationic surfactants (e.g., quaternary ammonium salt type surfactants, and amine salt type surfactants), ampholytic surfactants (e.g., carboxylic acid salt type surfactants, sulfuric acid ester salt type surfactants, sulfonic acid salt type surfactants, and phosphoric acid ester salt type surfactants), and nonionic surfactants (e.g., alkylene oxide addition type surfactants, and polyhydric alcohol type surfactants). These may be used alone or in combination of two or more kinds thereof.

The water-soluble polymer is not particularly limited but examples thereof include cellulose compounds (e.g., methyl cellulose, ethyl cellulose, hydroxyethyl cellulose, ethylhydroxy ethylcellulose, carboxymethyl cellulose, hydroxypropyl cellulose, and saponified products thereof), gelatin, starch, dextrin, gum arabic, chitin, chitosan, polyvinyl alcohol, polyvinyl pyrrolidone, polyethylene glycol, polyethylene imine, polyacryl amide, and polymers of acrylic acid (salt) (e.g., sodium polyacrylate, potassium polyacrylate, ammonium polyacrylate, partially neutralized products of polyacrylic acid with sodium hydroxide, and sodium acrylate-acrylic acid ester copolymers), (partially) neutralized products of styrene-maleic anhydride copolymers with sodium hydroxide, and water-soluble polyurethane (e.g., reaction products of polyisocyanate and polyethylene glycol and polycaprolactone diol).

In addition, as an auxiliary agent for the emulsifier or dispersant, the above organic solvent, a plasticizer, or the like can be used in combination of two or more kinds thereof.

The aqueous phase preferably contains resin particles.

The resin particles can be formed using a known polymerization method, but it is preferable to obtain them as a dispersion liquid of the resin.

A method for preparing the dispersion liquid of the resin is not particularly limited, but may be any of the following methods (a) to (i), for example.

(a) A method in which a vinyl monomer as a starting material is polymerized by the suspension polymerization method, the emulsification polymerization method, the seed polymerization method, or the dispersion polymerization method, to thereby directly prepare a dispersion liquid of the resin.

(b) A method in which a precursor (e.g., a monomer or an oligomer) of a polyaddition or condensation resin (e.g., a polyester, polyurethane, or epoxy resin) or a solution thereof is dispersed in water in the presence of a dispersant, and then cured by heating or by the addition of a curing agent, to thereby prepare a dispersion liquid of the resin.

(c) A method in which an emulsifier is dissolved in a precursor (e.g., a monomer or an oligomer) of a polyaddition or condensation resin (e.g., a polyester, polyurethane, or epoxy resin) or a solution thereof and is phase-inverted by the addition of water, to thereby prepare a dispersion liquid of the resin.

(d) A method in which a resin that has previously been synthesized through polymerization (e.g., addition polymerization, ring-opening polymerization, polyaddition, addition condensation, or condensation polymerization) is pulverized with a pulverizing mill of, for example, mechanical rotation-type or jet-type and is classified to obtain resin particles, which are then dispersed in water in the presence of a dispersant, to thereby prepare a dispersion liquid of the resin.

(e) A method in which a resin that has previously been synthesized through polymerization (e.g., addition polymerization, ring-opening polymerization, polyaddition, addition condensation, or condensation polymerization) is sprayed in the form of mist to obtain resin particles, which are then dispersed in water in the presence of a dispersant, to thereby prepare a dispersion liquid of the resin.

(f) A method in which a poor solvent is added to a resin that has previously been synthesized through polymerization (e.g., addition polymerization, ring-opening polymerization, polyaddition, addition condensation, or condensation polymerization) to precipitate resin particles, which are then dispersed in water in the presence of a suitable dispersant, to thereby prepare a dispersion liquid of the resin.

(g) A method in which a resin that has previously been synthesized through polymerization (e.g., addition polymerization, ring-opening polymerization, polyaddition, addition condensation, or condensation polymerization) is dissolved by heating and the resultant solution is cooled to precipitate resin particles, which are then dispersed in water in the presence of a suitable dispersant, to thereby prepare a dispersion liquid of the resin.

(h) A method in which a solution of a resin that has previously been synthesized through polymerization (e.g., addition polymerization, ring-opening polymerization, polyaddition, addition condensation, or condensation polymerization) is dissolved in water in the presence of a suitable dispersant, followed by removing the solvent by, for example, heating or reducing pressure, to thereby prepare a dispersion liquid of the resin.

(i) A method in which an emulsifier is dissolved in a solution of a resin that has previously been synthesized through polymerization (e.g., addition polymerization, ring-opening polymerization, polyaddition, addition condensation, or condensation polymerization) and the resultant is phase-inverted by the addition of water, to thereby prepare a dispersion liquid of the resin.

A volume average particle diameter of the resin particles is generally 10 nm to 300 nm, preferably 30 nm to 120 nm. When the volume average particle diameter of the resin particles is less than 10 nm or more than 300 nm, the particle size distribution of the resultant toner may become broad.

A solid content concentration of the oil phase is generally about 40% by mass to about 80% by mass.

Note that, the other materials than the binder resin (e.g., the colorant and the release agent) may be separately dissolved or dispersed in an organic solvent, and mixed with the solution or dispersion liquid of the binder resin.

The aqueous phase is generally water, but may be a solvent mixture of water and a water-miscible solvent.

The water-miscible solvent is not particularly limited but examples thereof include alcohols (e.g., methanol, isopropanol, and ethylene glycol), dimethyl formamide, tetrahydrofuran, cellosolves (e.g., methyl cellosolve), and lower ketones (e.g., acetone and methyl ethyl ketone).

A disperser used for dispersing or emulsifying the oil phase in the aqueous medium is not particularly limited but examples thereof include a low-speed shearing disperser, a high-speed shearing disperser, a friction disperser, a high-pressure jetting disperser, and an ultrasonic disperser). Among them, the high-speed shearing disperser is preferable from the viewpoint of making the particle size smaller.

The rotating speed of the high-speed shearing disperser is generally 1,000 rpm to 30,000 rpm, preferably 5,000 rpm to 20,000 rpm.

The temperature at which the dispersion is performed using the high-speed shearing disperser is generally 0° C. to 150° C. (under pressurization), preferably 20° C. to 80° C.

A method for removing the organic solvent is not particularly limited but is, for example, a method in which the temperature is gradually increased under normal pressure or reduced pressure with stirring, to evaporate and remove the organic solvent.

If necessary, the base particles may be dried after washing.

A method for washing the base particles is not particularly limited but is a method of repeatedly performing a process including; performing solid-liquid separation with a centrifugal separator, a filter press or the like; re-dispersing the base particles in water of normal temperature to about 40° C.; optionally adjusting the pH of the resultant dispersion with an acid or alkali; and performing the solid-liquid separation again.

In this process, fine particle components may be removed through, for example, centrifugal separation.

A drier used for drying the base particles is not particularly limited but examples thereof include a flash dryer, a circulation dryer, a vacuum dryer, and a vibration flash dryer.

In the drying, coarse particle components may be removed using, for example, a classifying device.

The ester extension method is a method in which an isocyanate group-containing polyester prepolymer is used in the dissolution suspension method as the polymer containing a group reactive with an active hydrogen group.

The emulsification aggregation method is a method in which a dispersion liquid of the binder resin, a dispersion liquid of the colorant, and a dispersion liquid of the release agent are mixed together and aggregated to produce base particles.

A method for preparing the dispersion liquid of the binder resin is not particularly limited but examples thereof include the emulsification polymerization method, the seed polymerization method, and the phase-inversion method.

A method for preparing the dispersion liquid of the colorant or release agent is not particularly limited but examples thereof include the wet dispersion method.

A method for controlling the aggregated state is not particularly limited but examples thereof include a method by adding a metal salt and a method by adjusting the pH.

The metal salt is not particularly limited but examples thereof include monovalent metal salts such as sodium salts and potassium salts, divalent metal salts such as calcium salts and magnesium salts, and trivalent metal salts such as aluminium salts.

An anion forming the metal salt is not particularly limited but examples thereof include a chloride ion, a buromide ion, an iodide ion, a carbonate ion, a sulfate ion.

The metal salt is preferably magnesium chloride, aluminium chloride, or a composite or multimer thereof.

Note that, heating is preferably performed in the course of the aggregation or after the aggregation. This can promote fusion between the particles to improve uniformity of the resultant base particles. Moreover, it is possible to control the shape of the toner, and the base particles become closer to a spherical shape.

Similar to the above, if necessary, the base particles may be dried after washing.

In order to increase flowability, storage stability, developability, and transferability of the toner, the external additive may be added to the base particles produced in the above-described manner.

A mixer used for mixing the base particles with the external additive is not particularly limited but examples thereof include V-type Mixer, Rocking Mixer, Lodige Mixer, Nauta Mixer, and Henschel Mixer.

The mixer is preferably adjustable in its inner temperature by a jacket or the like provided thereto.

Note that, the external additive may be added gradually or in the course of the mixing, in order to change the history of the load applied to the external additive. In this case, the number of rotations, rotation speed, mixing period, temperature and the like of the mixer may be changed. Also, a large load may initially be applied to the external additive, and next a relatively small load may be applied thereto, or vice versa.

After the mixing of the base particles and the external additive, the resultant mixture may be passed through a sieve of 250 mesh or more so as to remove coarse particles and aggregated particles.

An amount of THF (tetrahydrofuran) insoluble matter in the toner is preferably 10% by mass or less. In this case, the resultant toner can be improved in low temperature fixing ability.

A weight average molecular weight of the toner is preferably 5,000 to 18,000. When the weight average molecular weight of the toner is 5,000 or more, the resultant toner can be improved in separability to control the occurrence of the gloss afterimage. When the weight average molecular weight of the toner is 18,000 or less, the resultant toner can be improved in low temperature fixing ability.

Note that, the weight average molecular weight of the toner can be measured by gel permeation chromatography (GPC).

An average circularity of the toner is generally 0.950 to 0.980, preferably 0.960 to 0.975.

Particles having a circularity of less than 0.95 contained in the toner generally 15% or less.

Note that, the circularity of the toner can be measured using a flow-type particle image analyzer FPIA-2100 (product of SYSMEX CORPORATION), and can be analyzed using analytical software FPIA-2100 Data Processing Program for FPIA version 00-10 (product of SYSMEX CORPORATION).

A volume average particle diameter of the toner is generally 3 μm to 10 μm, preferably 4 μm to 7 μm.

A ratio of the volume average particle diameter to a number average particle diameter of the toner is generally 1.00 to 1.25, preferably 1.00 to 1.15.

Note that, the volume average particle diameter and the number average particle diameter of the toner can be measured using particle size analyzer MULTISIZER III (product of Beckman Coulter Co.) and be analyzed with analysis software Beckman Coulter Multisizer 3 Version 3.51 (product of Beckman Coulter Co.).

The toner may be used as a one-component developer, or a two-component developer containing the toner mixed with a carrier, but is preferably used as a two-component developer from the viewpoint of attaining a long service life in the case of being used in, for example, high-speed printers corresponding to the recent improved information processing speed.

The carrier preferably contains a core particle and a protective layer formed on a surface thereof.

A material forming the core particle is not particularly limited but examples thereof include ferromagnetic metals such as iron and cobalt, and iron oxides such as magnetite, hematite, and ferrite. Among them, from the viewpoint of environmental friendliness, Mn ferrite, Mn—Mg ferrite, and Mn—Mg—Sr ferrite are preferable.

The core particle may be a resin particle where magnetic materials such as various alloys and compound are dispersed.

A weight average particle diameter of the core particles is generally 10 μm to 80 preferably 20 μm to 65 μm.

Note that, the weight average particle diameter thereof can be calculated from the following formula based on the particle size distribution of the particles measured on a number basis with micro track particle size analyzer HRA9320-X100 (product of Honewell Co.):

$$\{1/\Sigma(nD^3)\}\times\{\Sigma(nD^4)\}$$

where D represents a representative particle diameter (μm) of particles present in each channel, and n represents the total number of particles present in each channel. Here, each channel is a length for dividing the range of the particle diameters in the particle size distribution diagram into a unit width for measurement.

The protective layer contains a resin and if necessary may further contains a filler, for example.

The resin is not particularly limited but examples thereof include polyolefin (e.g., polyethylene and polypropylene) and modified products thereof, polystyrene, acrylic resins; cross-linking copolymers of monomers containing acrylonitrile, vinyl acetate, vinyl chloride, vinyl carbazole or vinyl ether; silicone resins made of organo siloxane bonds and modified products thereof (e.g., modified with alkyd resins, polyester resins, epoxy resins, acrylic resins, polyurethane, and polyimide); polyamide; polyester; polyurethane; polycarbonate; urea resins; melamine resins; benzoguanamine resins; epoxy resins; ionomer resins; polyimide resins, and derivatives thereof. These may be used alone or in combination of two or more kinds thereof. Among them, silicone resins are preferable.

Examples of commercially available products of straight silicone resins include KR271, KR272, KR282, KR252, KR255, and KR152 (these products are of Shin-Etsu Chemical Co.); and SR2400, SR2405, and SR2406 (these products are of Dow Corning Toray Co.).

Examples of commercially available products of the modified silicone resins include ES-1001N (epoxy-modified silicone resin), KR-5208 (acryl-modified product), KR-5203 (polyester-modified product), KR-206 (alkyd-modified silicone resin), and KR-305 (urethane-modified silicone resin) (these products are of Shin-Etsu Chemical Co.); and SR2115 (epoxy-modified silicone resin) and SR2110 (alkyd-modified silicone resin) (these products are of Dow Corning Toray Co.).

Note that, the silicone resin may be used in combination with a cross-linkable component, a charge amount-controlling component, or the like.

Examples of the cross-linkable component include silane coupling agents (e.g., methyltrimethoxy silane, methyltriethoxy silane, octyltrimethoxy silane, and amino silane coupling agents).

The filler is not particularly limited but examples thereof include electroconductive fillers and non-electroconductive fillers. These may be used alone or in combination of two or more kinds thereof.

The electroconductive filler refers to a filler having a specific electrical resistance of 100 Ω·cm or lower. The non-electroconductive filler refers to a filler having a specific electrical resistance of higher than 100 Ω·cm.

Note that, the specific electrical resistance value can be measured using powder resistance measurement system MCP-PD51 (product of Mitsubishi Chemical Analytech Co.) and 4-terminal and 4-probe type resistivity meter Loresta-GP (product of Mitsubishi Chemical Analytech Co.).

Examples of the electroconductive filler include electroconductive fillers containing a layer of tin dioxide or indium oxide formed on a base such as aluminium oxide, titanium oxide, zinc oxide, barium sulfate, silicon oxide, or zirconium oxide; and electroconductive fillers made using carbon black. Among them, electroconductive fillers containing aluminum oxide, titanium oxide, and barium sulfate are preferable.

Examples of the non-electroconductive filler include non-electroconductive fillers made using, for example, aluminium oxide, titanium oxide, barium sulfate, zinc oxide, silicon dioxide, or zirconium oxide. Among them, non-electroconductive fillers containing aluminum oxide, titanium oxide, and barium sulfate are preferable.

The carrier is preferably produced using a fluidized-bed coating device by coating a protective layer-coating liquid containing the resin and the filler on the surface of the core particle.

Note that, the resin may be condensed during or after the coating of the protective layer-coating liquid.

A method for condensing the resin is not particularly limited but examples thereof include a method by applying energy such as heat or light.

A mass ratio of the toner to the carrier in the two-component developer is generally 0.020 to 0.12, preferably 0.025 to 0.10.

The image forming apparatus includes a photoconductor, a charging unit configured to charge the photoconductor, an exposing unit configured to expose the charged photoconductor to light to form an electrostatic latent image, a developing unit containing a toner and configured to develop, with the toner, the electrostatic latent image formed on the photoconductor to form a toner image, a transfer unit configured to transfer the toner image formed on the photoconductor to a recording medium, and a fixing unit configured to fix the toner image transferred to the recording medium, and if necessary, further includes a charge-eliminating unit, a cleaning unit, a recycle portion, and a control portion, for example.

A shape of the photoconductor is generally a drum shape.

A material of the photoconductor is not particularly limited but examples thereof include inorganic compounds such as amorphous silicon and selenium and organic compounds such as polysilane and phthalopolymethine. Among them, organic compounds are preferable since high-definite images can be obtained.

The charging unit is not particularly limited, but examples thereof include a contact-type charger provided with, for example, an electroconductive or semi-electroconductive roller, brush, film and rubber blade, and a non-contact-type charger utilizing corona discharge such as corotron and scorotron.

The charging unit is disposed so as to be in contact with or not to be in contact with the photoconductor.

The charging unit is preferably configured to apply direct voltage and alternating voltage in a superimposing manner to charge the surface of the photoconductor.

Also, the charging unit is preferably a charging roller which is disposed contactlessly but proximately to the photoconductor via a gap tape, and which is configured to apply direct voltage and alternating voltage in a superimposing manner to charge the surface of the photoconductor.

The exposing unit is not particularly limited so long as it can imagewise expose the surface of the photoconductor to light, but examples thereof include a copy optical system, a rod lens array system, a laser optical system, and a liquid crystal shutter optical system.

Note that, it may be possible to employ a manner in which the photoconductor is imagewise exposed to light from the back side thereof.

The developing unit is not particularly limited so long as it houses the toner and can apply the toner to the electrostatic latent image formed on the surface of the photoconductor in a contact or contactless manner. The developing unit is preferably a developer provided with a container containing the toner.

The developing unit may be a developing unit for a single color, or a developing unit for multicolor.

The developing unit preferably contains a stirrer for frictionally stirring the toner to charge the toner, and a rotatable magnet roller.

In the developing unit, the toner and the carrier are stirred and mixed so that the toner is charged by friction generated therebetween. The charged toner is retained in the chain-like form on the surface of the rotating magnetic roller to form a magnetic brush. The magnetic roller is disposed proximately to the photoconductor and thus, some of the toner forming the magnetic brush on the magnet roller are electrically transferred onto the surface of the photoconductor. As a result, the electrostatic latent image is developed with the toner to form a visible toner image on the surface of the photoconductor.

The transfer unit preferably includes a primary transfer device configured to transfer the toner image formed on the surface of the photoconductor onto an intermediate transfer member, and a secondary transfer device configured to transfer the toner image transferred onto the intermediate transfer member to a recording medium.

The intermediate transfer member is not particularly limited but examples thereof include a transfer belt.

The transfer unit (primary transfer device and secondary transfer device) is preferably configured to charge and peel off the toner image formed on the surface of the photoconductor onto the recording medium.

The transfer unit may be used alone, or may be a plurality of the transfer units may be used in combination of two or more kinds thereof.

The transfer unit is not particularly limited but examples thereof include a corona transfer device using corona discharge, a transfer belt, a transfer roller, a press transfer roller, and an adhesion transfer device.

The recording medium is not particularly limited but examples thereof include recording paper.

The fixing unit is not particularly limited but examples thereof include a combination of a heat roller and a pressure roller, and a combination of a heat roller, a pressure roller and an endless belt.

The fixing unit preferably includes a heating body provided with a heat generator, a film which contacts the film, a press member which is pressed against the heating body via the film, and is configured to pass the recording medium between the film and the press member to fix the toner image formed thereon.

The heating temperature of the fixing unit is generally 80° C. to 200° C.

Note that, a photofixing device may be used together with the fixing unit.

The charge-eliminating unit is not particularly limited as long as it can apply a charge-eliminating bias to the photoconductor, but examples thereof include charge-eliminating lamp.

The cleaning unit is not particularly limited as long as it can remove the toner remaining on the photoconductor, but examples thereof include a magnetic brush cleaner, an electrostatic brush cleaner, a magnetic roller cleaner, a blade cleaner, a brush cleaner, and a web cleaner.

The recycle portion is not particularly limited but examples thereof include a conveyance unit configured to convey the toner.

The control portion is not particularly limited but examples thereof include a sequencer and a computer.

One example of an image forming apparatus is shown in FIG. 1.

A image forming apparatus 100A includes a photoconductor drum 10, a charging roller 20, an exposing device (not illustrated), a developing device 40, an intermediate transfer belt 50, a cleaning device 60 which includes a cleaning blade, and a charge-eliminating lamp 70.

The intermediate transfer belt 50 is an endless belt which is supported by three rollers 51 disposed inside the endless belt and is movable in a direction indicated by the arrow in FIG. 1. A part of the three rollers 51 also functions as a transfer bias roller which may apply a predetermined transfer bias (primary transfer bias) to the intermediate transfer belt 50. Also, a cleaning device 90 including a cleaning blade is disposed near the intermediate transfer belt 50. Further, a transfer roller 80 which can apply a transfer bias for transferring (secondary transferring) a developed image (toner image) onto transfer paper 95 is disposed facing the intermediate transfer belt 50. In addition, around the intermediate transfer belt 50, a corona charging device 58 for applying a charge to the toner image transferred on the intermediate transfer belt 50 is disposed between a contact portion of the electrostatic latent image bearer 10 with the intermediate transfer belt 50 and a contact portion of the intermediate transfer belt 50 with the transfer paper 95 in a rotational direction of the intermediate transfer belt 50.

The developing device 40 includes a developing belt 41 and a black developing unit 45K, a yellow developing unit 45Y, a magenta developing unit 45M and a cyan developing unit 45C which are arranged around the developing belt 41. Here, each of the developing units 45 includes a developer container 42, a developer supply roller 43 and a developing roller 44. Also, the developing belt 41 is an endless belt which is supported by a plurality of belt rollers, and is movable in a direction indicated by the arrow in FIG. 1. Moreover, the developing belt 41 is partially in contact with the photoconductor drum 10.

Next, a method for forming an image by using the image forming apparatus 100A will be described hereinafter.

The charging roller 20 uniformly charges a surface of the photoconductor drum 10, and then the exposing device (not illustrated) exposes the photoconductor drum 10 to exposing light L, to thereby form an electrostatic latent image. Next, the electrostatic latent image formed on the photoconductor drum 10 is developed with a toner supplied from the developing device 40, to thereby form a toner image. Further, the toner image formed on the photoconductor drum 10 is transferred (primarily transferred) onto the intermediate transfer belt 50 by the transfer bias applied from the roller 51 and is then transferred (secondarily transferred) onto transfer paper 95 by the transfer bias applied from a transfer roller 80. Meanwhile, a residual toner remaining on the photoconductor drum 10, from which the toner image has been transferred onto the intermediate transfer belt 50, is removed by the cleaning device 60, and the photoconductor drum 10 is once charge-eliminated by the charge-eliminating lamp 70.

Figure 2:
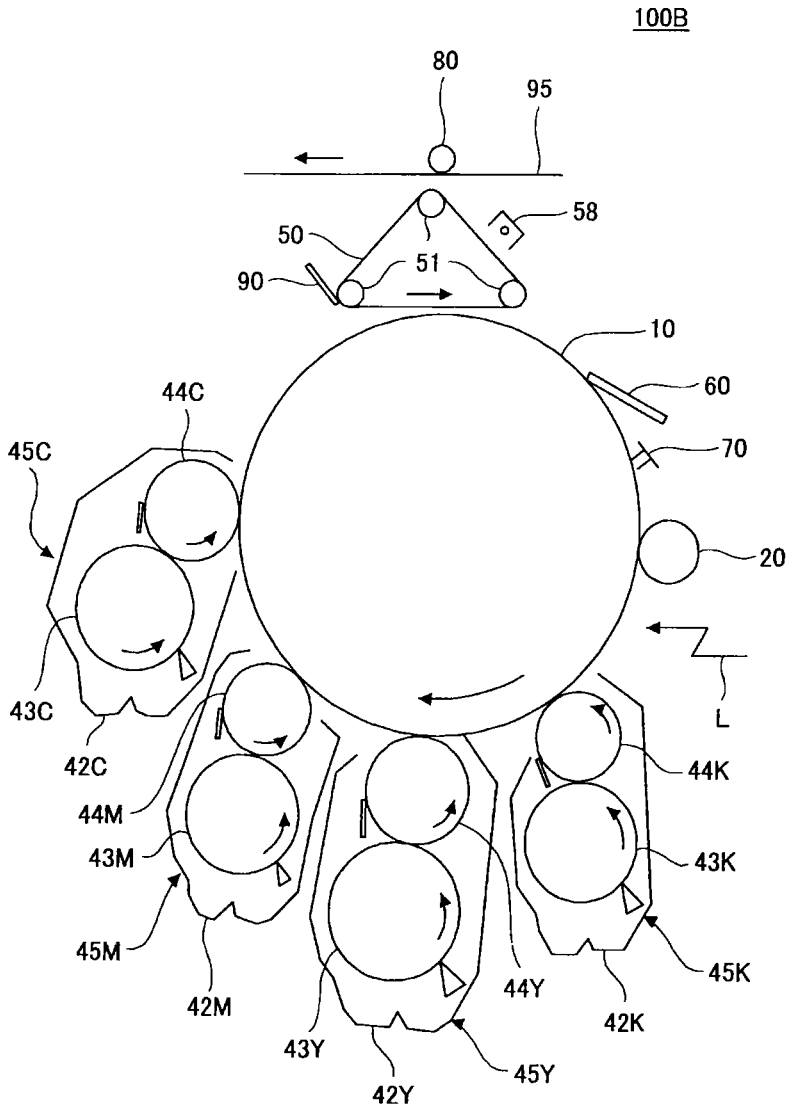
FIG. 2 is a schematic view of another example of an image forming apparatus.

FIG. 2 illustrates another example of the image forming apparatus.

An image forming apparatus 100B has the same configuration as the image forming apparatus 100A except that the developing belt 41 is not included and that, around the photoconductor drum 10, the black developing unit 45K, the yellow developing unit 45Y, the magenta developing unit 45M and the cyan developing unit 45C are disposed facing directly to the electrostatic latent image bearer.

Figure 3:
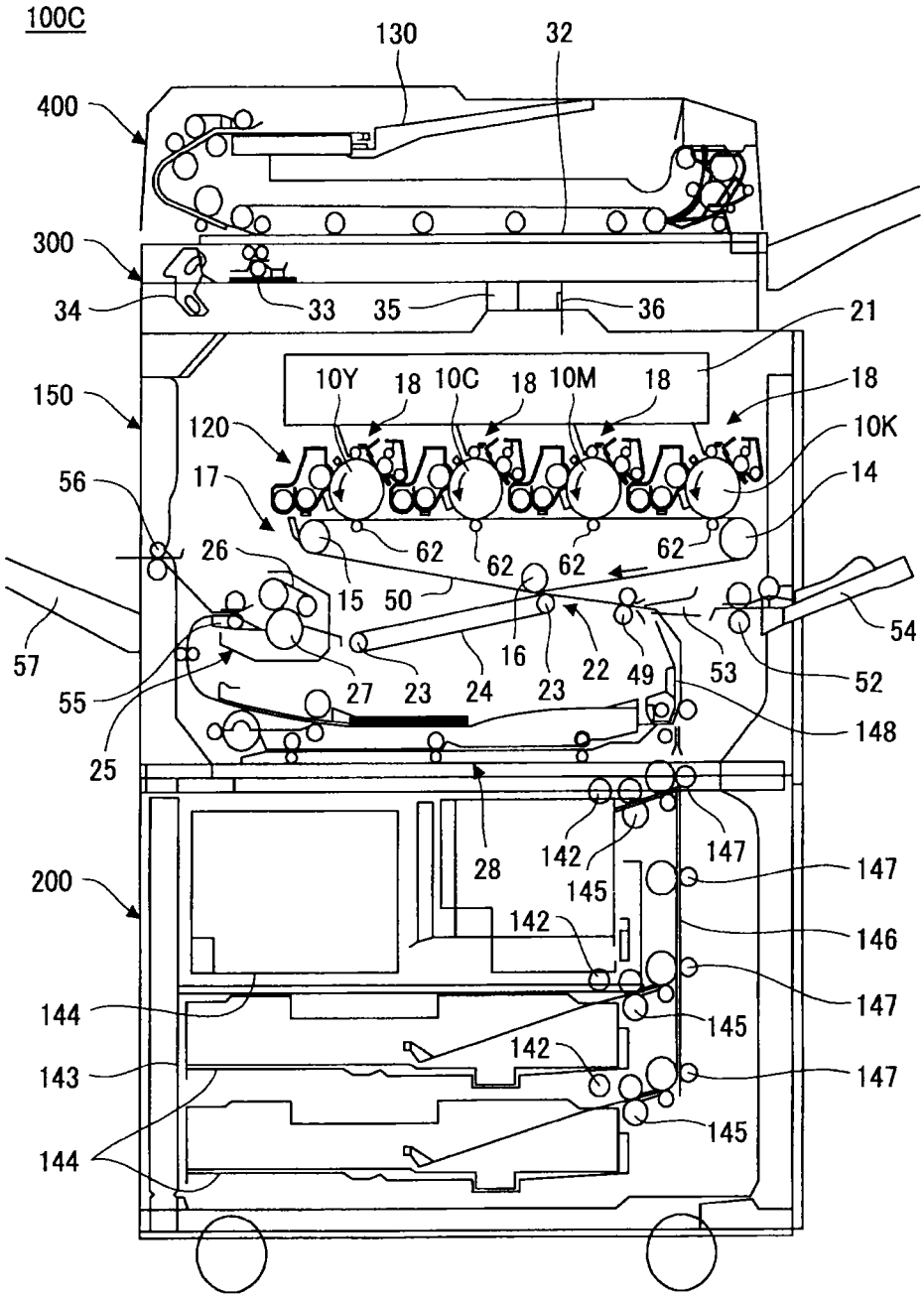
FIG. 3 is a schematic view of still another example of an image forming apparatus.

FIG. 3 illustrates another example of the image forming apparatus.

An image forming apparatus 100C is a tandem type color image forming apparatus, and includes a copying device main body 150, a paper feeding table 200, a scanner 300 and an automatic document feeder (ADF) 400.

An intermediate transfer belt 50 which is an endless belt is disposed at a central part of the copying device main body 150, is stretched around three rollers 14, 15, and 16, and can rotate in a direction indicated by the arrow in FIG. 3. Near the roller 15, a cleaning device 17 including a cleaning blade is disposed in order to remove a residual toner remaining on the intermediate transfer belt 50 from which the toner image has been transferred. On the intermediate transfer belt 50 supported by the rollers 14 and 15, a tandem type developing device 120 is disposed in which image forming units 18 of yellow, cyan, magenta and black are arranged in parallel so as to face to each other along a conveying direction thereof. Moreover, an exposing device 21 is disposed near the tandem type developing device 120. Further, a secondary transfer device 22 is disposed on a side of the intermediate transfer belt 50 opposite to the side on which the tandem type developing device 120 is disposed. In the secondary transfer device 22, the secondary transfer belt 24 which is an endless belt is stretched around a pair of rollers 23, and the recording paper conveyed on the secondary transfer belt 24 and the intermediate transfer belt 50 may contact with each other. Near the secondary transfer device 22, a fixing belt 26 which is supported by a pair of rollers and a fixing device 25 containing a press roller 27 which is disposed so as to be pressed against the fixing belt 26 are disposed. Here, a sheet inverting device 28 is disposed near the secondary transfer belt 24 and the fixing device 25 for inverting the recording paper in the case of forming images on both sides of the recording paper.

Next, a method for forming a full-color image using the image forming apparatus 100C will be described.

First, a color document is set on a document table 130 of the automatic document feeder (ADF) 400. Alternatively, the automatic document feeder 400 is opened, the color document is set on a contact glass 32 of the scanner 300, and the automatic document feeder 400 is closed. When a start button (not illustrated) is pressed, the scanner 300 activates after the color document is conveyed and moved to the contact glass 32 in the case the color document has been set on the automatic document feeder 400, or right away in the case the color document has been set on the contact glass 32, so that a first travelling body 33 containing a light source and a second travelling body 34 containing a mirror travel. At this time, a light is irradiated from the first travelling body 33, the light reflected from a surface of the document is reflected by the second travelling body 34 and then is received by a reading sensor 36 through an imaging lens 35. Thus, the color document (color image) is read to thereby form black, yellow, magenta and cyan image information.

Figure 4:
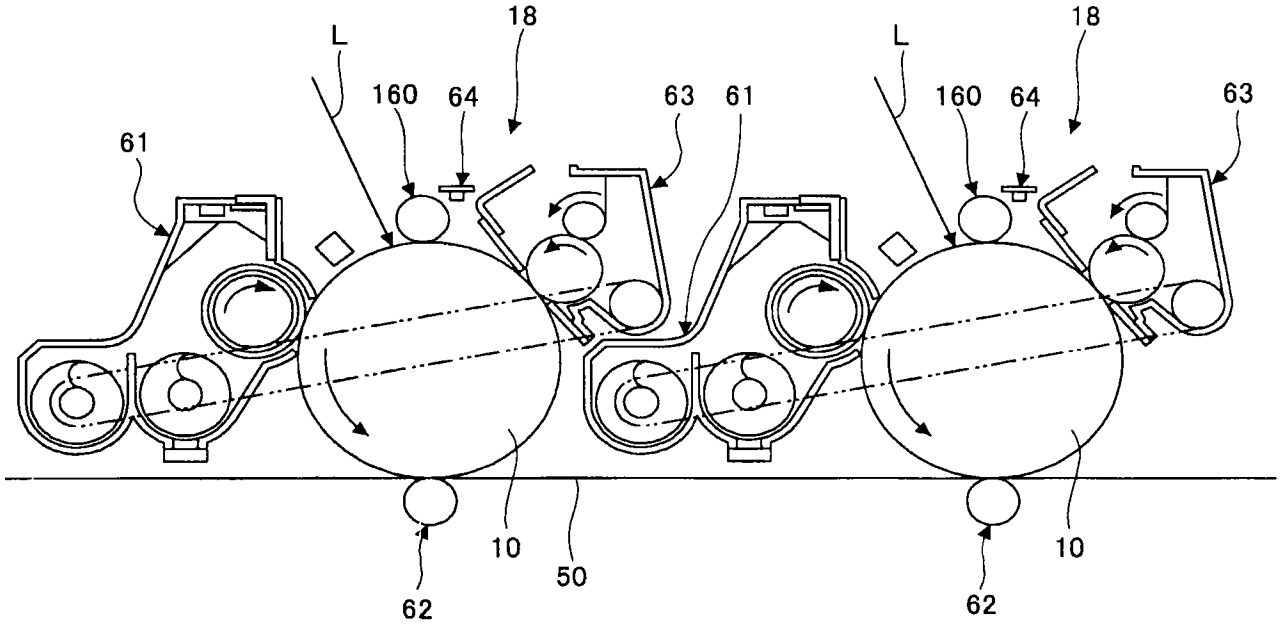
FIG. 4 is a partially enlarged view of the image forming apparatus of FIG. 3.

The image information of each of the colors is transmitted to each of the image forming units 18, and each of the toner images is formed. As illustrated in FIG. 4, each of the image forming units 18 (black, magenta, yellow, and cyan) includes a photoconductor drum 10; a charging roller 160 configured to uniformly charge the photoconductor drum 10; an exposing device configured to imagewise expose the photoconductor drum 10 to exposing light L based on color image information to form an electrostatic latent image of each of the colors; a developing device 61 configured to develop the electrostatic latent image with a developer of each of the color, to thereby form a toner image; a transfer roller 62 configured to transfer the toner image onto the intermediate transfer belt 50; a cleaning device 63 including a cleaning blade; and a charge-eliminating lamp 64.

Each of the toner images formed in each of the image forming units 18 (black, magenta, yellow, and cyan) was sequentially transferred (primarily transferred) onto the intermediate transfer belt 50, which is supported by rollers 14, 15, and 16, to thereby form a composite color image.

Meanwhile, on the paper feeding table 200, one of paper feeding rollers 142 is selectively rotated to feed recording paper from one of the paper feeding cassettes 144 equipped in multiple stages in a paper bank 143. The sheet is separated one by one by a separation roller 145 and sent to a paper feeding path 146. The sheet (recording paper) is conveyed by a conveying roller 147 and is guided to a paper feeding path 148 in the copying device main body 150, and stops by colliding with a registration roller 49. Alternatively, a paper feeding roller is rotated to feed a sheet (recording paper) on a manual feed tray 54. The sheet (recording paper) is separated one by one by a separation roller 52 and is guided to a manual paper feeding path 53, and stops by colliding with the registration roller 49.

Note that, the registration roller 49 is generally used while grounded, but it may also be used in a state that a bias is being applied for removing paper dust on the sheet.

Next, by rotating the registration roller 49 in accordance with the timing of the composite toner formed on the intermediate transfer belt 50, the recording paper is fed to between the intermediate transfer belt 50 and the secondary transfer belt 24. Thereby, the composite toner image is transferred (secondarily transferred) onto the recording paper. Notably, the composite toner image is transferred on the intermediate transfer belt 50, and a residual toner remaining thereon is removed by the cleaning device for the intermediate transfer belt 17.

The recording paper on which the color image has been transferred is conveyed by a secondary transfer belt 24, and then is fixed by the fixing device 25. Next, the recording paper is discharged by a discharge roller 56 and stacked in a paper discharge tray 57 through a conveyance route switched by a switching claw 55. Alternatively, through a conveyance route switched by the switching claw 55, the recording paper is inverted by an inverting device 28, an image is formed similarly on the rear surface, and thus, the recording paper is discharged by the discharge roller 56 stacked in the paper discharge tray 57.

EXAMPLES

The present invention will next be described by way of Examples, which should not be construed as limiting the present invention thereto. Note that, the unit "part(s)" means "part(s) by mass".

<Synthesis of Crystalline Polyester 1>

A reaction vessel equipped with a condenser, a stirrer, and a nitrogen-introducing pipe was charged with 202 parts of sebacic acid, 154 parts of 1,6-hexanediol, and 0.5 parts of tetrabutoxytitanate (serving as a condensation catalyst). The mixture was allowed to react at 180° C. for 8 hours under a stream of nitrogen while removing water formed. Next, the reaction mixture was gradually increased to 220° C. and was allowed to react for 4 hours under a stream of nitrogen while removing water formed and 1,6-hexanediol. Thereafter, the reaction mixture was allowed to react at a reduced pressure of 5 mmHg to 20 mmHg until the weight average molecular weight of the reaction product reached about 15,000, to thereby obtain crystalline polyester 1. The crystalline polyester 1 was found to have a weight average molecular weight of 14,000, a melting point of 66° C., and a softening temperature of 75° C.

<Softening Temperature>

The softening temperature was measured with elevated flow tester CFT-500D (product of Shimadzu Corporation). Specifically, while 1 g of a sample was heated at the heating rate of 6° C./min, a load of 1.96 MPa was applied by a plunger to extrude the sample from a nozzle having a diameter of 1 mm and length of 1 mm, during which an amount of descent of the plunger of the flow tester was plotted versus the temperature. The temperature at which half of the sample was flown out was determined as a softening temperature of the sample.

<Melting Point>

The melting point was measured with differential scanning calorimeters TA-60WS and DSC-60 (these products are of Shimadzu Corporation). Specifically, a sample was melted at 130° C., and then was cooled from 130° C. to 70° C. at the rate of 1.0° C./min and was cooled from 70° C. to 10° C. at the rate of 0.5° C./rain. At this time, the sample was heated at the rate of 20° C./rain and was measured for an endothermic-exothermic change. Based on this measurement, a graph of the endothermic/exothermic amount versus the temperature was drawn. In the graph, an endothermic peak temperature in a temperature range from 20° C. to 100° C. was determined as "Ta*". In the case where there were some endothermic peaks within the aforementioned temperature range, the temperature of the peak at which the endothermic amount was the largest was determined as Ta*. Thereafter, the sample was stored for 6 hours at the temperature that was (Ta*−10) ° C. and was stored for another 6 hours at the temperature that was (Ta*−15) ° C. Further, the sample was cooled to 0° C. at the cooling rate of 10° C./min and then was heated at the heating rate of 20° C./min for measurement of the endothermic/exothermic change, to thereby draw a graph of the endothermic/exothermic amount versus the temperature. In the graph, the temperature corresponding to the maximum peak of the endothermic/exothermic amount is determined as a melting point.

<Preparation of Ethyl Acetate Dispersion Liquid of Crystalline Polyester 1>

A vessel equipped with a stirring rod and a thermometer was charged with 85 parts of the crystalline polyester 1 and 415 parts of ethyl acetate, and the mixture was heated to 75° C. Next, the mixture was cooled to 10° C. or lower for 1 hour, and then was dispersed for 5 hours using beads mill ULTRAVISCOMILL (product of Aimex CO., LTD.) under the following conditions: liquid feed rate of 1 kg/hr, disc circumferential velocity of 6 m/s, and 0.5 mm-zirconia beads packed to 80% by volume, to thereby obtain ethyl acetate dispersion liquid of the crystalline polyester 1.

<Synthesis of Non-crystalline Polyester 1>

A reaction vessel equipped with a condenser, a stirrer, and a nitrogen-introducing pipe was charged with 315 parts of bisphenol A ethylene oxide 2 mol adduct, 180 parts of bisphenol A propylene oxide 2 mol adduct, 150 parts of terephthalic acid, 15 parts of adipic acid, and 0.5 parts of tetrabutoxy titanate, and the resultant mixture was allowed to react for 8 hours at 230° C. under a stream of nitrogen while formed water was removed by distillation. Next, the reaction mixture was allowed to react at a reduced pressure of 5 mmHg to 20 mmHg, and then was cooled to 180° C. at the time point when the acid value thereof reached 2 mgKOH/g. Thereafter, 13 parts of trimellitic anhydride was added thereto, and the resultant mixture was allowed to react for 3 hours to thereby obtain non-crystalline polyester 1. The non-crystalline polyester 1 was found to have a weight average molecular weight of 3,000 and a glass transition temperature of 52° C.

<Synthesis of Non-crystalline Polyester 2>

Non-crystalline polyester 2 was obtained in the same manner as in the synthesis of non-crystalline polyester 1 except that the amount of the bisphenol A ethylene oxide 2 mol adduct charged was changed to 303 parts and the amount of the bisphenol A propylene oxide 2 mol adduct charged was changed to 174 parts. The non-crystalline polyester 2 was found to have a weight average molecular weight of 4,000 and a glass transition temperature of 53° C.

<Synthesis of Non-crystalline Polyester 3>

Non-crystalline polyester 3 was obtained in the same manner as in synthesis of non-crystalline polyester 1 except that the amount of the bisphenol A ethylene oxide 2 mol adduct charged was changed to 294 parts and the amount of the bisphenol A propylene oxide 2 mol adduct charged was changed to 167 parts. The non-crystalline polyester 3 was found to have a weight average molecular weight of 5,000 and a glass transition temperature of 54° C.

<Synthesis of Non-crystalline Polyester 4>

Non-crystalline polyester 4 was obtained in the same manner as in the synthesis of non-crystalline polyester 1 except that the amount of the bisphenol A ethylene oxide 2 mol adduct charged was changed to 282 parts and the amount of the bisphenol A propylene oxide 2 mol adduct charged was changed to 148 parts. The non-crystalline polyester 4 was found to have a weight average molecular weight of 7,000 and a glass transition temperature of 56° C.

<Synthesis of Non-crystalline Polyester 5>

Non-crystalline polyester 5 was obtained in the same manner as in the synthesis of non-crystalline polyester 1 except that the amount of the bisphenol A ethylene oxide 2 mol adduct charged was changed to 264 parts and the amount of the bisphenol A propylene oxide 2 mol adduct charged was changed to 141 parts. The non-crystalline polyester 5 was found to have a weight average molecular weight of 9,000 and a glass transition temperature of 56° C.

<Synthesis of Non-crystalline Polyester 6>

Non-crystalline polyester 6 was obtained in the same manner as in the synthesis of non-crystalline polyester 1 except that the amount of the bisphenol A ethylene oxide 2 mol adduct charged was changed to 327 parts and the amount of the bisphenol A propylene oxide 2 mol adduct charged was changed to 187 parts. The non-crystalline polyester 6 was found to have a weight average molecular weight of 2,000 and a glass transition temperature of 52° C.

<Synthesis of Non-crystalline Polyester 7>

A reaction vessel equipped with a condenser, a stirrer, and a nitrogen-introducing pipe was charged with 222 parts of bisphenol A ethylene oxide 2 mol adduct, 128 parts of bisphenol A propylene oxide 2 mol adduct, 150 parts of terephthalic acid, 15 parts of adipic acid, and 0.5 parts of tetrabutoxy titanate, and the resultant mixture was allowed to react for 8 hours at 230° C. under nitrogen flow while formed water was removed by distillation. Next, the reaction mixture was allowed to react at a reduced pressure of 5 mmHg to 20 mmHg, and then was cooled to 180° C. at the time point when the weight average molecular weight thereof reached 13,000. Thereafter, 13 parts of trimellitic anhydride was added thereto, and the resultant mixture was allowed to react for 3 hours to thereby obtain non-crystalline polyester 7. The non-crystalline polyester 7 was found to have a weight average molecular weight of 13,000 and a glass transition temperature of 60° C.

<Synthesis of Non-crystalline Polyester 8>

A reaction vessel equipped with a condenser, a stirrer, and a nitrogen-introducing pipe was charged with 240 parts of bisphenol A ethylene oxide 2 mol adduct, 138 parts of bisphenol A propylene oxide 2 mol adduct, 166 parts of terephthalic acid, and 0.5 parts of tetrabutoxy titanate, and the resultant mixture was allowed to react for 8 hours at 230° C. under nitrogen flow while formed water was removed by distillation. Next, the reaction mixture was allowed to react at a reduced pressure of 5 mmHg to 20 mmHg, and then was cooled to 180° C. at the time point when the weight average molecular weight thereof reached 33,000. Thereafter, 13 parts of trimellitic anhydride was added thereto, and the resultant mixture was allowed to react for 3 hours to thereby obtain non-crystalline polyester 8. The non-crystalline polyester 8 was found to have a weight average molecular weight of 33,000 and a glass transition temperature of 63° C.

<Synthesis of Non-crystalline Polyester 9>

Non-crystalline polyester 9 was obtained in the same manner as in the synthesis of non-crystalline polyester 8 except that the amount of the bisphenol A ethylene oxide 2 mol adduct charged was changed to 210 parts, the amount of the bisphenol A propylene oxide 2 mol adduct charged was changed to 121 parts, and the reaction mixture was allowed to react at a reduced pressure of 5 mmHg to 20 mmHg at the time point when the weight average molecular weight thereof reached 38,000. The non-crystalline polyester 9 was found to have a weight average molecular weight of 38,000 and a glass transition temperature of 64° C.

<Synthesis of Polyester Prepolymer 1>

A reaction vessel equipped with a condenser, a stirrer, and a nitrogen-introducing pipe was charged with 708 parts of bisphenol A ethylene oxide 2 mol adduct, 82 parts of bisphenol A propylene oxide 2 mol adduct, 291 parts of terephthalic acid, and 1 part of tetrabutoxy titanate, and the resultant mixture was allowed to react for 8 hours at 230° C. under nitrogen flow while formed water was removed by distillation. Next, the reaction mixture was allowed to react for 7 hours at a reduced pressure of 10 mmHg to 15 mmHg, to thereby obtain a hydroxyl group containing polyester. A hydroxyl group containing polyester was found to have a weight average molecular weight of 8,200.

A reaction vessel equipped with a condenser, a stirrer, and a nitrogen-introducing pipe was charged with 400 parts of the hydroxyl group containing polyester, 95 parts of isophorone diisocyanat, and 500 parts of ethyl acetate, and the resultant mixture was allowed to react at 80° C. for 8 hours under nitrogen flow, to thereby obtain an ethyl acetate solution of polyester prepolymer 1. The polyester prepolymer 1 was found to contain a free isocynate group in an amount of 1.52% by mass.

<Synthesis of Polyester Prepolymer 2>

An ethyl acetate solution of polyester prepolymer 2 was obtained in the same manner as in the synthesis of polyester prepolymer 1 except that the amount of the bisphenol A ethylene oxide 2 mol adduct charged was changed to 630 parts and the amount of the bisphenol A propylene oxide 2 mol adduct charged was changed to 66 parts. A hydroxyl group containing polyester was found to have a weight average molecular weight of 13,500. The polyester prepolymer 2 was found to contain a free isocynate group in an amount of 1.40% by mass.

<Synthesis of Polyester Prepolymer 3>

An ethyl acetate solution of polyester prepolymer 3 was obtained in the same manner as in the synthesis of polyester prepolymer 1 except that the amount of the bisphenol A ethylene oxide 2 mol adduct charged was changed to 660 parts and the amount of the bisphenol A propylene oxide 2 mol adduct charged was changed to 72 parts. A hydroxyl group containing polyester was found to have a weight average molecular weight of 9,300. The polyester prepolymer 3 was found to contain a free isocynate group in an amount of 1.47% by mass.

<Synthesis of Polyester Prepolymer 4>

An ethyl acetate solution of polyester prepolymer 4 was obtained in the same manner as in the synthesis of polyester prepolymer 1 except that the amount of the bisphenol A ethylene oxide 2 mol adduct charged was changed to 726 parts and the amount of the bisphenol A propylene oxide 2 mol adduct charged was changed to 92 parts. A hydroxyl group containing polyester was found to have a weight average molecular weight of 7,000. The polyester prepolymer 4 was found to contain a free isocynate group in an amount of 1.58% by mass.

<Synthesis of Graft Polymer 1>

A reaction vessel equipped with a stirring rod and a thermometer was charged with 480 parts of xylene and 100 parts of SUNWAX LEL-400 of a low-molecular-weight polyethylene having a softening point of 128° C. (product of Sanyo Chemical Industries, Ltd.). The reaction vessel was purged with nitrogen and the mixture was heated to 170° C. Next, a mixture of styrene (740 parts), acrylonitrile (100 parts), butyl acrylate (60 parts), di-t-butylperoxy hexahydroterephthalate (36 parts), and xylene (100 parts) was added dropwise thereto for 3 hours and maintained for 30 minutes. Thereafter, the solvent was removed from the mixture to thereby obtain graft polymer 1. The graft polymer 1 was found to have a weight average molecular weight of 24,000 and a glass transition temperature of 67° C.

<Preparation of Ethyl Acetate Dispersion Liquid of Release Agent 1>

A vessel equipped with a stirring rod and a thermometer was charged with 50 parts of microcrystalline wax (HI-MIC-1090, product of NIPPON SEIRO CO., LTD.) having a melt viscosity at 100° C. of 26 mPa·s, an onset temperature of 62° C., and a melting point of 80° C., 30 parts of the graft polymer 1, and 420 parts of ethyl acetate. Thereafter, the mixture was heated to 80° C. and was maintained for 5 hours. The mixture was cooled to 30° C. for 1 hour and then was dispersed using beads mill ULTRAVISCOMILL (product of Aimex CO., LTD.) under the following conditions: liquid feed rate of 1 kg/hr, disc circumferential velocity of 6 m/s, 0.5 mm-zirconia beads packed to 80% by volume, and 3 passes, to thereby obtain ethyl acetate dispersion liquid of release agent 1.

<Preparation of Ethyl Acetate Dispersion Liquid of Release Agent 2>

Ethyl acetate dispersion liquid of release agent 2 was obtained in the same manner as in the preparation of ethyl acetate dispersion liquid of release agent 1 except that the microcrystalline wax (HI-MIC-1090, product of NIPPON SEIRO CO., LTD.) was changed to microcrystalline wax (Be Square 195, product of TOYO ADL CORPORATION) having a melt viscosity ηw at 100° C. of 30 mPa·s, an onset temperature of 49° C., and a melting point of 65° C.

<Preparation of Ethyl Acetate Dispersion Liquid of Release Agent 3>

Ethyl acetate dispersion liquid of release agent 3 was obtained in the same manner as in the preparation of ethyl acetate dispersion liquid of release agent 1 except that the microcrystalline wax HI-MIC-1090 (product of NIPPON SEIRO CO., LTD.) was changed to microcrystalline wax Hi-Mic-1080 (product of NIPPON SEIRO CO., LTD.) having a melt viscosity ηw at 100° C. of 20 mPa·s, an onset temperature of 55° C., and a melting point of 73° C.

<Preparation of Ethyl Acetate Dispersion Liquid of Release Agent 4>

Ethyl acetate dispersion liquid of release agent 4 was obtained in the same manner as in the preparation of ethyl acetate dispersion liquid of release agent 1 except that the microcrystalline wax Hi-Mic-1090 (product of NIPPON SEIRO CO., LTD.) was changed to ester wax WEP-9 (product of NOF CORPORATION) having a melt viscosity ηw at 100° C. of 17 mPa·s, an onset temperature of 66° C., and a melting point of 70° C.

<Preparation of Ethyl Acetate Dispersion Liquid of Release Agent 5>

Ethyl acetate dispersion liquid of release agent 5 was obtained in the same manner as in the preparation of ethyl acetate dispersion liquid of release agent 1 except that microcrystalline wax HI-MIC-1090 (product of NIPPON SEIRO CO., LTD.) was changed to carnauba wax WA05 (product of TOYO ADL CORPORATION) having a melt viscosity ηw at 100° C. of 31 mPa·s, an onset temperature of 72° C., and a melting point of 81° C.

<Preparation of Ethyl Acetate Dispersion Liquid of Release Agent 6>

Ethyl acetate dispersion liquid of release agent 6 was obtained in the same manner as in the preparation of ethyl acetate dispersion liquid of release agent 1 except that the microcrystalline wax HI-MIC-1090 (product of NIPPON SEIRO CO., LTD.) was changed to paraffin wax HNP-9 (product of NIPPON SEIRO CO., LTD.) having a melt viscosity ηw at 100° C. of 7 mPa·s, an onset temperature of 71° C., and a melting point of 76° C.

<Preparation of Ethyl Acetate Dispersion Liquid of Release Agent 7>

Ethyl acetate dispersion liquid of release agent 7 was obtained in the same manner as in the preparation of ethyl acetate dispersion liquid of release agent 1 except that the microcrystalline wax HI-MIC-1090 (product of NIPPON SEIRO CO., LTD.) was changed to paraffin wax HNP-11 (product of NIPPON SEIRO CO., LTD.) having a melt viscosity ηw at 100° C. of 5 mPa·s, an onset temperature of 66° C., and a melting point of 70° C.

<Preparation of Ethyl Acetate Dispersion Liquid of Release Agent 8>

Fischer Tropsch wax FT-0165 (product of NIPPON SEIRO CO., LTD.) was distilled in vacuo, followed by repeatedly washing with methyl butyl ketone in a state of being dissolved for purification.

Ethyl acetate dispersion liquid of release agent 8 was obtained in the same manner as in the preparation of ethyl acetate dispersion liquid of release agent 1 except that the microcrystalline wax HI-MIC-1090 (product of NIPPON SEIRO CO., LTD.) was changed to the purified Fischer Tropsch wax having a melt viscosity ηw at 100° C. of 23 mPa·s, an onset temperature of 67° C., and a melting point of 72° C.

<Preparation of Ethyl Acetate Dispersion Liquid of Release Agent 9>

Rice wax TOWAX-3F3 (product of TOA KASEI CO., LTD.) was emulsified in an ethanol of 75° C., followed by repeatedly washing in order to filtrate an insoluble matter for purification.

Ethyl acetate dispersion liquid of release agent 9 was obtained in the same manner as in the preparation of ethyl acetate dispersion liquid of release agent 1 except that the microcrystalline wax HI-MIC-1090 (product of NIPPON SEIRO CO., LTD.) was changed to the purified rice wax having a melt viscosity ηw at 100° C. of 24 mPa·s, an onset temperature of 77° C., and a melting point of 82° C.

Physical properties of the release agents 1 to 9 are shown in Table 1.

TABLE 1

| Release agents | Kinds | ηw [mPa · s] | Onset temperature [° C.] | Melting point [° C.] |
|---|---|---|---|---|
| 1 | Microcrystalline wax | 26 | 62 | 80 |
| 2 | Microcrystalline wax | 30 | 49 | 65 |
| 3 | Microcrystalline wax | 20 | 55 | 73 |
| 4 | Ester wax | 17 | 66 | 70 |
| 5 | Carnauba wax | 31 | 72 | 81 |
| 6 | Paraffin wax | 7 | 71 | 76 |
| 7 | Paraffin wax | 5 | 66 | 70 |
| 8 | Fischer Tropsch wax | 23 | 67 | 72 |
| 9 | Rice wax | 24 | 77 | 82 |

<Melt Viscosity ηw at 100° C. >

A release agent (60 g) was charged into a 100 mL screw bial bottle, followed by heating. Using a water bath or an aluminum block, the resultant mixture was kept at a constant temperature of 100° C., was kept warm at the temperature, and then was completely allowed to be dissolved. For the measurement, a viscometer (DV-Eviscosity, product of BROOKFIELD) was used, and a rotor having the lowest torque range LV (#1) was used. The rotor was soaked in the melted release agent, and then left to stand for 2 minutes. The release agent precipitated on the surface of the rotor was confirmed to be completely dissolved, followed by rotating at 100 rpm for 1 minute, and then the obtained value was determined as a measurement.

<Onset Temperature and Melting Point>

An onset temperature and a melting point were measured using TA-60WS and DSC-60 (products of SHIMADZU CORPORATION) based on the following conditions, and were analyzed using a data analyzing software TA-60 (version: 1.52, product of SHIMADZU CORPORATION).

Sample container: aluminum sample pan with a lid
Amount of sample: 5 mg
Reference: aluminum sample pan (alumina 10 mg)
Atmosphere: nitrogen (flow rate: 50 mL/min)
First Heating
  Start temperature: 20° C.
  Heating rate: 10° C./min
  End temperature: 150° C.
  Holding time not provided
First Cooling
  Cooling rate: 10° C./min
  End temperature: 20° C.
  Holding time not provided
Second Heating
  Heating rate: 10° C./min
  End temperature: 150° C.

Note that, in the lowest side of the endothermic peak measured in second heating, an onset temperature is at a temperature corresponded to a point of intersection between a tangent line where the gradient of a curve is the largest (point of inflection) and an extended line of the base line. Also, a melting point is a peak top temperature of the endothermic peak measured in second heating.

<Preparation of Master Batch 1>

Using a Henschel mixer (product of NIPPON COKE & ENGINEERING CO., LTD.), 100 parts of the non-crystalline polyester 1, 100 parts of carbon black PRINTEX 35 (product of Evonik Degussa Japan Co., Ltd., DBP oil absorption amount=42 mL/100 g, pH=9.5), and 50 parts of water were mixed, and the resultant mixture was kneaded by a two roll.

An this time, the resultant mixture was started to knead at 90° C., and then was gradually cooled to 50° C., followed by pulverizing by a pulverizer (product of Hosokawa Micron Corporation), to thereby obtain master batch 1.

<Preparation of Master Batch 2>

Master batch 2 was obtained in the same manner as in the preparation of master batch 1 except that the non-crystalline polyester 1 was changed to the non-crystalline polyester 2.

<Preparation of Master Batch 3>

Master batch 3 was obtained in the same manner as in the preparation of master batch 1 except that the non-crystalline polyester 1 was changed to the non-crystalline polyester 3.

<Preparation of Master Batch 4>

Master batch 4 was obtained in the same manner as in the preparation of master batch 1 except that the non-crystalline polyester 1 was changed to the non-crystalline polyester 4.

<Preparation of Master Batch 5>

Master batch 5 was obtained in the same manner as in the preparation of master batch 1 except that the non-crystalline polyester 1 was changed to the non-crystalline polyester 5.

<Preparation of Master Batch 6>

Master batch 6 was obtained in the same manner as in the preparation of master batch 1 except that the non-crystalline polyester 1 was changed to the non-crystalline polyester 6.

<Preparation of Aqueous Dispersion Liquid of Vinyl Resin 1>

A reaction vessel equipped with a stirring rod and a thermometer was charged with 600 parts of water, 120 parts of styrene, 100 parts of methacrylic acid, 45 parts of butyl acrylate, 10 parts of ELEMINOL JS-2 (product of Sanyo Chemical Industries, Ltd.), which is a sodium salt of alkylallylsulfo succinic acid, and 1 part of ammonium persulphate, followed by stirring for 20 minutes at 400 rpm. Next, the resultant mixture was heated to 75° C., and then, allowed to react for 6 hours. Moreover, a 1% by mass aqueous ammonium persulphate solution (30 parts) was added thereto, and then, matured at 75° C. for 6 hours, to thereby obtain aqueous dispersion liquid of vinyl resin 1. The aqueous dispersion liquid of vinyl resin 1 was found to have a volume average particle diameter of 60 nm. The vinyl resin 1 was found to have a weight average molecular weight of 140,000 and a glass transition temperature of 73° C.

Note that, the volume average particle diameter of the aqueous dispersion liquid of vinyl resin 1 was measured by particle size distribution measuring apparatus LA-920 (product of HORIBA, Ltd.).

<Preparation of Aqueous Phase 1>

Water (990 parts), 83 parts of the aqueous dispersion liquid of vinyl resin 1, 37 parts of an aqueous dodecyldiphenyl ether sodium disulphonate solution in an amount of 48.5% by mass (ELEMINOL MON-7, product of Sanyo Chemical Industries, Ltd.), and 90 parts of ethyl acetate were mixed and stirred, to thereby obtain aqueous phase 1.

<Production of Toner 1>

—Preparation of Oil Phase 1—

A container equipped with a thermometer and a stirrer was charged with 108 parts of the non-crystalline polyester 1, 118 parts of the ethyl acetate dispersion liquid of crystalline polyester 1, 120 parts of the ethyl acetate dispersion liquid of release agent 1, and 20 parts of the master batch 1, followed by pre-dispersion by a stirrer. Next, the resultant mixture was stirred at 5,000 rpm by a TK homomixer (product of PRIMIX Corporation), to thereby obtain oil phase 1.

—Emulsifying or Dispersing—

A container was charged with 365 parts of the oil phase 1, 32 parts of the ethyl acetate solution of polyester prepolymer 1, and 3 parts of an ethyl acetate solution of isophoronediamine in an amount of 50% by mass. Next, the resultant mixture was stirred at 5,000 rpm by a TK homomixer (product of PRIMIX Corporation), to thereby obtain oil phase 1'.

A container equipped with a thermometer and a stirrer was charged with 550 parts of the aqueous phase 1. While the aqueous phase 1 was stirred by a TK homomixer (product of PRIMIX Corporation) at 13,000 rpm, the oil phase 1' was added thereto, followed by emulsifying for 1 minute, to thereby obtain emulsified slurry 1.

—Removing Solvent, Washing, and Drying—

A container equipped with a thermometer and a stirrer was charged with the emulsified slurry 1, followed by removing the solvent at 30° C. for 8 hours, to thereby obtain slurry 1.

The slurry 1 was subjected to filtration under a reduced pressure, to thereby obtain a filtration cake. Then, 100 parts of ion-exchanged water was added to the filtration cake, and the resultant mixture was mixed by a TK homomixer at 6,000 rpm for 5 minutes, followed by filtration. Then, 100 parts of ion-exchanged water was added to the filtration cake, and the resultant mixture was mixed by a TK homomixer at 6,000 rpm for 5 minutes. Next, 1% by mass hydrochloric acid was added thereto until the pH was about 3.3, and then the resultant mixture was stirred for 1 hour, followed by filtration. Ion-exchanged water (300 parts) was added to the filtration cake, and the resultant mixture was mixed by a TK homomixer at 6,000 rpm for 5 minutes, followed by filtration, which was treated twice. Ion-exchanged water (300 parts) was added to the filtration cake. Then, the resultant mixture was heated to 55° C., and was maintained for 15 minutes, followed by filtration.

The filtration cake was dried by an air-circulating drier at 40° C. for 48 hours, and then was caused to pass through a sieve with a mesh size of 75 μm, to thereby obtain toner base particles.

—Addition of External Additive—

The base particles (100 parts), 1.15 parts of hydrophobized-treated silica UFP-35 having a number average particle diameter of 80 nm (product of Denki Kagaku Kogyo Kabushiki Kaisha), 1.10 parts of hydrophobized-treated silica H2000 having a number average particle diameter of 12 nm (product of Clariant(Japan)K.K.), and 0.70 parts of hydrophobized-treated titanium oxide JMT-150IB having a number average particle diameter of 20 nm (product of TAYCA CORPORATION) were mixed by a Henschel mixer (product of NIPPON COKE & ENGINEERING CO., LTD.), and the resultant mixture was caused to pass through a sieve of 500 mesh, to thereby obtain toner 1. The toner 1 was found to have a melt viscosity $\eta t$ at 100° C. of 920 Pa·s, contain THF insoluble matter in an amount of 3% by mass, and have a weight average molecular weight (Mw) of 7,560.

<Production of Toner 2>

—Preparation of Oil Phase 2—

A container equipped with a thermometer and a stirrer was charged with 120 parts of the non-crystalline polyester 2, 120 parts of the ethyl acetate dispersion liquid of the release agent 2, 20 parts of the master batch 2, and 60 parts of ethyl acetate, followed by pre-dispersion by a stirrer. Next, the resultant mixture was stirred at 5,000 rpm by a TK homomixer (product of PRIMIX Corporation), to thereby obtain oil phase 2.

—Emulsifying or Dispersing—

A container was charged with 320 parts of the oil phase 2, 56 parts of the ethyl acetate solution of polyester prepolymer 2, and 3 parts of an isophoronediamine containing ethyl acetate solution in an amount of 50% by mass, followed by stirring by a TK homomixer (product of PRIMIX Corporation) at 5,000 rpm, to thereby obtain oil phase 2'.

A container equipped with a stirrer and a thermometer was charged with 500 parts of the aqueous phase 1, followed by stirring by a TK homomixer (product of PRIMIX Corporation) at 13,000 rpm. During stirring, the oil phase 2' was added thereto, followed by emulsifying for 1 minute, to thereby obtain emulsified slurry 2.

Toner 2 was obtained in the same manner as in the production of toner 1 except that the emulsified slurry 1 was changed to the emulsified slurry 2. The toner 2 was found to have a melt viscosity ηt at 100° C. of 7,200 Pa·s, contain THF insoluble matter in an amount of 11% by mass, and have a weight average molecular weight (Mw) of 13,570.

<Production of Toner 3>

—Preparation of Oil Phase 3—

A container equipped with a thermometer and a stirrer was charged with 108 parts of the non-crystalline polyester 3, 80 parts of the ethyl acetate dispersion liquid of crystalline polyester 1, 120 parts of the ethyl acetate dispersion liquid of release agent 3, and 20 parts of master batch 3, followed by pre-dispersion by a stirrer. Next, the resultant mixture was stirred at 5,000 rpm by a TK homomixer (product of PRIMIX Corporation), to thereby obtain oil phase 3.

—Emulsifying or Dispersing—

A container was charged with 328 parts of the oil phase 3, 80 parts of the ethyl acetate solution of polyester prepolymer 3, and 3 parts of an isophoronediamine containing ethyl acetate solution in an amount of 50% by mass. Using a TK homomixer (product of PRIMIX Corporation), the resultant mixture was stirred at 5,000 rpm, to thereby obtain oil phase 3'.

A container equipped with a stirrer and a thermometer was charged with 500 parts of the aqueous phase 1, followed by stirring by a TK homomixer (product of PRIMIX Corporation) at 13,000 rpm. During stirring, the oil phase 3' was added thereto, followed by emulsifying for 1 minute, to thereby obtain emulsified slurry 3.

Toner 3 was obtained in the same manner as in the production of toner 1 except that the emulsified slurry 1 was changed to the emulsified slurry 3. The toner 3 was found to have a melt viscosity ηt at 100° C. of 2,300 Pa·s, contain THF insoluble matter in an amount of 9% by mass, and have a weight average molecular weight (Mw) of 11,200.

<Production of Toner 4>

Toner 4 was obtained in the same manner as in the production of toner 3 except that the ethyl acetate dispersion liquid of release agent 3 was changed to the ethyl acetate dispersion liquid of release agent 2. The toner 4 was found to have a melt viscosity ηt at 100° C. of 2,800 Pa·s, contain THF insoluble matter in an amount of 9% by mass, and have a weight average molecular weight (Mw) of 11,390.

<Production of Toner 5>

Toner 5 was obtained in the same manner as in the production of toner 3 except that the ethyl acetate dispersion liquid of release agent 3 was changed to the ethyl acetate dispersion liquid of release agent 1. The toner 5 was found to have a melt viscosity ηt at 100° C. of 2,500 Pa·s, contain THF insoluble matter in an amount of 9% by mass, and have a weight average molecular weight (Mw) of 11,600.

<Production of Toner 6>

—Preparation of Oil Phase 6—

A container equipped with a thermometer and a stirrer was charged with 108 parts of the non-crystalline polyester 2, 80 parts of the ethyl acetate dispersion liquid of crystalline polyester 1, 120 parts of the ethyl acetate dispersion liquid of release agent 1, and 20 parts of the master batch 2, followed by pre-dispersion by a stirrer. Next, the resultant mixture was stirred at 5,000 rpm by a TK homomixer (product of PRIMIX Corporation), to thereby obtain oil phase 6.

—Emulsifying or Dispersing—

A container was charged with 328 parts of the oil phase 6, 52 parts of the ethyl acetate solution of polyester prepolymer 3, and 3 parts of an isophoronediamine containing ethyl acetate solution in an amount of 50% by mass. Using a TK homomixer (product of PRIMIX Corporation), the resultant mixture was stirred at 5,000 rpm, to thereby obtain oil phase 6'.

A container equipped with a stirrer and a thermometer was charged with 500 parts of the aqueous phase 1, followed by stirring by a TK homomixer (product of PRIMIX Corporation) at 13,000 rpm. During stirring, the oil phase 6' was added thereto, followed by emulsifying for 1 minute, to thereby obtain emulsified slurry 6.

Toner 6 was obtained in the same manner as in the production of toner 1 except that the emulsified slurry 1 was changed to the emulsified slurry 6. The toner 6 was found to have a melt viscosity ηt at 100° C. of 6,900 Pa·s, contain THF insoluble matter in an amount of 10% by mass, and have a weight average molecular weight (Mw) of 10,830.

<Production of Toner 7>

—Preparation of Oil Phase 7—

A container equipped with a thermometer and a stirrer was charged with 108 parts of the non-crystalline polyester 2, 80 parts of the ethyl acetate dispersion liquid of crystalline polyester 1, 120 parts of the ethyl acetate dispersion liquid of release agent 2, 20 parts of the master batch 2, followed by pre-dispersion by a stirrer. Next, the resultant mixture was stirred at 5,000 rpm by a TK homomixer (product of PRIMIX Corporation), to thereby obtain oil phase 7.

—Emulsifying or Dispersing—

A container was charged with 328 parts of the oil phase 7, 60 parts of the ethyl acetate solution of polyester prepolymer 3, and 3 parts of an isophoronediamine containing ethyl acetate solution in an amount of 50% by mass. Using a TK homomixer (product of PRIMIX Corporation), the resultant mixture was stirred at 5,000 rpm, to thereby obtain oil phase 7'.

A container equipped with a stirrer and a thermometer was charged with 500 parts of the aqueous phase 1, followed by stirring by a TK homomixer (product of PREMIX Corporation) at 13,000 rpm. During stirring, the oil phase 7' was added thereto, followed by emulsifying for 1 minute, to thereby obtain emulsified slurry 7.

Toner 7 was obtained in the same manner as in the production of toner 1 except that the emulsified slurry 1 was changed to the emulsified slurry 7. The toner 7 was found to have a melt viscosity ηt at 100° C. of 7,400 Pa·s, contain THF insoluble matter in an amount of 12% by mass, and have a weight average molecular weight (Mw) of 11,550.

<Production of Toner 8>

—Preparation of Oil Phase 8—

A container equipped with a thermometer and a stirrer was charged with 108 parts of the non-crystalline polyester 4, 80 parts of the ethyl acetate dispersion liquid of crystalline polyester 1, 120 parts of the ethyl acetate dispersion liquid of release agent 1, and 20 parts of the master batch 4, followed by pre-dispersion by a stirrer. Next, the resultant mixture was stirred at 5,000 rpm by a TK homomixer (product of PRIMIX Corporation), to thereby obtain oil phase 8.

—Emulsifying or Dispersing—

A container was charged with 328 parts of the oil phase 8, 66 parts of the ethyl acetate solution of polyester prepolymer 2, and 3 parts of an isophoronediamine containing ethyl acetate solution in an amount of 50% by mass. Using a TK homomixer (product of PRIMIX Corporation), the resultant mixture was stirred at 5,000 rpm, to thereby obtain oil phase 8'.

A container equipped with a stirrer and a thermometer was charged with 500 parts of the aqueous phase 1, followed by stirring by a TK homomixer (product of PRIMIX Corporation) at 13,000 rpm. During stirring, the oil phase 8' was added thereto, followed by emulsifying for 1 minute, to thereby obtain emulsified slurry 8.

Toner 8 was obtained in the same manner as in the production of toner 1 except that the emulsified slurry 1 was changed to the emulsified slurry 8. The toner 8 was found to have a melt viscosity ηt at 100° C. of 7,600 Pa·s, contain THF insoluble matter in an amount of 13% by mass, and have a weight average molecular weight (Mw) of 17,840.

<Production of Toner 9>

—Preparation of Oil Phase 9—

A container equipped with a thermometer and a stirrer was charged with 108 parts of the non-crystalline polyester 1, 80 parts of the ethyl acetate dispersion liquid of crystalline polyester 1, 120 parts of the ethyl acetate dispersion liquid of release agent 1, and 20 parts of the master batch 1, followed by pre-dispersion by a stirrer. Next, the resultant mixture was stirred at 5,000 rpm by a TK homomixer (product of PRIMIX Corporation), to thereby obtain oil phase 9.

—Emulsifying or Dispersing—

A container was charged with 328 parts of the oil phase 9, 24 parts of the ethyl acetate solution of polyester prepolymer 4, and 3 parts of an isophoronediamine containing ethyl acetate solution in an amount of 50% by mass. Using a TK homomixer (product of PRIMIX Corporation), the resultant mixture was stirred at 5,000 rpm, to thereby obtain oil phase 9'.

A container equipped with a stirrer and a thermometer was charged with 500 parts of the aqueous phase 1, followed by stirring by a TK homomixer (product of PRIMIX Corporation) at 13,000 rpm. During stirring, the oil phase 9' was added thereto, followed by emulsifying for 1 minute, to thereby obtain emulsified slurry 9.

Toner 9 was obtained in the same manner as in the production of toner 1 except that the emulsified slurry 1 was changed to the emulsified slurry 9. The toner 9 was found to have a melt viscosity ηt at 100° C. of 700 Pa·s, contain THF insoluble matter in an amount of 1% by mass, and have a weight average molecular weight (Mw) of 5,810.

<Production of Toner 10>

—Preparation of Oil Phase 10—

A container equipped with a thermometer and a stirrer was charged with 106 parts of the non-crystalline polyester 5, 80 parts of the ethyl acetate dispersion liquid of crystalline polyester 1, 120 parts of the ethyl acetate dispersion liquid of release agent 2, and 20 parts of the master batch 5, followed by pre-dispersion by a stirrer. Next, the resultant mixture was stirred at 5,000 rpm by a TK homomixer (product of PRIMIX Corporation), to thereby obtain oil phase 10.

—Emulsifying or Dispersing—

A container was charged with 326 parts of the oil phase 10, 74 parts of the ethyl acetate solution of polyester prepolymer 2, and 3 parts of an isophoronediamine containing ethyl acetate solution in an amount of 50% by mass. Using a TK homomixer (product of PRIMIX Corporation), the resultant mixture was stirred at 5,000 rpm, to thereby obtain oil phase 10'.

A container equipped with a stirrer and a thermometer was charged with 500 parts of the aqueous phase 1, followed by stirring by a TK homomixer (product of PRIMIX Corporation) at 13,000 rpm. During stirring, the oil phase 10' was added thereto, followed by emulsifying for 1 minute, to thereby obtain emulsified slurry 10.

Toner 10 was obtained in the same manner as in the production of toner 1 except that the emulsified slurry 1 was changed to the emulsified slurry 10. The toner 10 was found to have a melt viscosity ηt at 100° C. of 7,900 Pa·s, contain THF insoluble matter in an amount of 15% by mass, and have a weight average molecular weight (Mw) of 20,290.

<Production of Toner 11>

—Preparation of Oil Phase 11—

A container equipped with a thermometer and a stirrer was charged with 108 parts of the non-crystalline polyester 6, 80 parts of the ethyl acetate dispersion liquid of crystalline polyester 1, 120 parts of the ethyl acetate dispersion liquid of release agent 3, and 20 parts of the master batch 6, followed by pre-dispersion by a stirrer. Next, the resultant mixture was stirred at 5,000 rpm by a TK homomixer (product of PRIMIX Corporation), to thereby obtain oil phase 11.

—Emulsifying or Dispersing—

A container was charged with 328 parts of the oil phase 11, 20 parts of the ethyl acetate solution of polyester prepolymer 4, and 3 parts of an isophoronediamine containing ethyl acetate solution in an amount of 50% by mass. Using a TK homomixer (product of PRIMIX Corporation), the resultant mixture was stirred at 5,000 rpm, to thereby obtain oil phase 11'.

A container equipped with a stirrer and a thermometer was charged with 500 parts of the aqueous phase 1, followed by stirring by a TK homomixer (product of PRIMIX Corporation) at 13,000 rpm. During stirring, the oil phase 11' was added thereto, followed by emulsifying for 1 minute, to thereby obtain emulsified slurry 11.

Toner 11 was obtained in the same manner as in the production of toner 1 except that the emulsified slurry 1 was changed to the emulsified slurry 11. The toner 11 was found to have a melt viscosity ηt at 100° C. of 550 Pa·s, contain THF insoluble matter in an amount of 1% by mass, and have a weight average molecular weight (Mw) of 4,715.

<Production of Toner 12>

—Preparation of Oil Phase 12—

A container equipped with a thermometer and a stirrer was charged with 108 parts of the non-crystalline polyester 3, 80 parts of the ethyl acetate dispersion liquid of crystalline polyester 1, 120 parts of the ethyl acetate dispersion liquid of release agent 1, and 20 parts of the master batch 3, followed by pre-dispersion by a stirrer. Next, the resultant mixture was stirred at 5,000 rpm by a TK homomixer (product of PRIMIX Corporation), to thereby obtain oil phase 12.

—Emulsifying or Dispersing—

A container was charged with 328 parts of the oil phase 12, 50 parts of the ethyl acetate solution of polyester prepolymer 3, and 3 parts of an isophoronediamine containing ethyl acetate solution in an amount of 50% by mass. Using a TK homomixer (product of PRIMIX Corporation), the resultant mixture was stirred at 5,000 rpm, to thereby obtain oil phase 12'.

A container equipped with a stirrer and a thermometer was charged with 500 parts of the aqueous phase 1, followed by stirring by a TK homomixer (product of PRIMIX Corporation) at 13,000 rpm. During stirring, the oil phase 12' was added thereto, followed by emulsifying for 1 minute, to thereby obtain emulsified slurry 12.

Toner 12 was obtained in the same manner as in the production of toner 1 except that the emulsified slurry 1 was changed to the emulsified slurry 12. The toner 12 was found to have a melt viscosity ηt at 100° C. of 2,400 Pa·s, contain THF insoluble matter in an amount of 9% by mass, and have a weight average molecular weight (Mw) of 11,330.

<Production of Toner 13>

—Preparation of Oil Phase 13—

A container equipped with a thermometer and a stirrer was charged with 110 parts of the non-crystalline polyester 2, 19 parts of the non-crystalline polyester 8, 120 parts of the ethyl acetate dispersion liquid of release agent 1, 20 parts of the master batch 2, and 60 parts of ethyl acetate, followed by pre-dispersion by a stirrer. Next, the resultant mixture was stirred at 5,000 rpm by a TK homomixer (product of PRIMIX Corporation), to thereby obtain oil phase 13.

—Emulsifying or Dispersing—

A container equipped with a stirrer and a thermometer was charged with 470 parts of the aqueous phase 1, followed by stirring by a TK homomixer (product of PREMIX Corporation) at 13,000 rpm. During stirring, 310 parts of the oil phase 13 was added thereto, followed by emulsifying for 1 minute, to thereby obtain emulsified slurry 13.

Toner 13 was obtained in the same manner as in the production of toner 1 except that the emulsified slurry 1 was changed to the emulsified slurry 13. The toner 13 was found to have a melt viscosity ηt at 100° C. of 4,300 Pa·s, contain THF insoluble matter in an amount of 2% by mass, and have a weight average molecular weight (Mw) of 7,960.

<Production of Toner 14>

—Preparation of Oil Phase 14—

A container equipped with a thermometer and a stirrer was charged with 96 parts of the non-crystalline polyester 2, 19 parts of the non-crystalline polyester 8, 80 parts of the ethyl acetate dispersion liquid of crystalline polyester 1, 120 parts of the ethyl acetate dispersion liquid of release agent 1, and 20 parts of the master batch 2, followed by pre-dispersion by a stirrer. Next, the resultant mixture was stirred at 5,000 rpm by a TK homomixer (product of PRIMIX Corporation), to thereby obtain oil phase 14.

—Emulsifying or Dispersing—

A container equipped with a stirrer and a thermometer was charged with 480 parts of the aqueous phase 1, followed by stirring by a TK homomixer (product of PRIMIX Corporation) at 13,000 rpm. During stirring, 316 parts of the oil phase 14 was added thereto, followed by emulsifying for 1 minute, to thereby obtain emulsified slurry 14.

Toner 14 was obtained in the same manner as in the production of toner 1 except that the emulsified slurry 1 was changed to the emulsified slurry 14. The toner 14 was found to have a melt viscosity ηt at 100° C. of 2,000 Pa·s, contain THF insoluble matter in an amount of 2% by mass, and have a weight average molecular weight (Mw) of 8,960.

<Preparation of Aqueous Dispersion Liquid of Non-crystalline Polyester 7>

The non-crystalline polyester 7 (60 parts) and 60 parts of ethyl acetate were mixed, to thereby obtain aqueous dispersion liquid of noncrystalline polyester 7.

Water (120 parts), 2 parts of an anionic surfactant NEOGEN R (product of Dai-ichi Kogyo Seiyaku Co., Ltd.), 2.4 parts of 2% by mass aqueous sodium hydroxide were mixed, to thereby obtain an aqueous phase.

The ethyl acetate solution of non-crystalline polyester 7 (120 parts) was added to the obtained aqueous phase, followed by emulsifying by a homogenizer (ULTRA-TURRAX T50, product of IKA). Next, the resultant mixture was emulsified by a Manton Gaulin high-pressure homogenizer (product of Gaulin) to thereby obtain an emulsified slurry.

A container equipped with a stirrer and a thermometer was charged with the obtained emulsified slurry, followed by removing the solvent at 30° C. for 4 hours, to thereby obtain aqueous dispersion liquid of non-crystalline polyester 7. The aqueous dispersion liquid of non-crystalline polyester 7 was found to have a volume average particle diameter of 0.15 μm.

<Preparation of Aqueous Dispersion Liquid of Non-crystalline Polyester 8>

Aqueous dispersion liquid of non-crystalline polyester 8 was obtained in the same manner as in the preparation of the aqueous dispersion liquid of non-crystalline polyester 7 except that the non-crystalline polyester 7 was changed to the non-crystalline polyester 8, to thereby obtain aqueous dispersion liquid of non-crystalline polyester 8. The aqueous dispersion liquid of non-crystalline polyester 8 was found to have the volume average particle diameter of 0.16 μm.

Note that, the volume average particle diameter in the aqueous dispersion liquid of non-crystalline polyester 7 and the aqueous dispersion liquid of non-crystalline polyester 8 was measured by a particle size distribution measuring apparatus (LA-920, product of HORIBA, Ltd.).

<Preparation of Aqueous Dispersion Liquid of Release Agent 1>

Microcrystalline wax HI-MIC-1090 (product of NIPPON SEIRO CO., LTD.) (25 parts), 1 part of an anionic surfactant (NEOGEN R, product of Dai-ichi Kogyo Seiyaku Co., Ltd.), and 200 parts of water were mixed, and then heated to 90° C. Next, the resultant mixture was emulsified by a homogenizer (ULTRA-TURRAX T50, product of IKA), followed by emulsifying using a Manton Gaulin high-pressure homogenizer (product of Gaulin), to thereby obtain aqueous dispersion liquid of release agent 1.

<Preparation of Aqueous Dispersion Liquid of Colorant 1>

Carbon black (PRINTEX 35, product of Degussa) (20 parts), 0.5 parts of anionic surfactant (NEOGEN R, product of Dai-ichi Kogyo Seiyaku Co., Ltd.), and 80 parts of water were mixed, followed by dispersing using a TK homomixer (product of PREMIX Corporation), to thereby obtain aqueous dispersion liquid of colorant 1.

<Production of Toner 15>

A container equipped with a thermometer and a stirrer was charged with 235 parts of the aqueous dispersion liquid of non-crystalline polyester 7, 57 parts of the aqueous dispersion liquid of non-crystalline polyester 8, 45 parts of the aqueous dispersion liquid of release agent 1, 34 parts of the aqueous dispersion of colorant 1, and 600 parts of water, followed by stirring at 30° C. for 30 minutes. Next, a pH was adjusted to 10 with 2% by mass aqueous sodium hydroxide, followed by stirring by a homogenizer (ULTRA-TURRAX T50, product of IKA) at 5,000 rpm. Then, the resultant mixture was heated to 45° C., while 50 parts of 5% by mass aqueous magnesium chloride was gradually added dropwise thereto. The heated mixture was maintained until the particles were grown to have a volume average particle diameter of 5.2 μm. Moreover, while pH was maintained to 9 by adding 2% by mass aqueous sodium hydroxide thereto, the resultant mixture was heated to 90° C., and then, was maintained at the temperature for 2 hours. Then, the resultant mixture was cooled to 20° C. at a ratio of 1° C./rain, to thereby obtain slurry 15.

Toner 15 was obtained in the same manner as in the production of toner 1 except that the slurry 1 was changed to the slurry 15. The toner 15 was found to have a melt viscosity ηt at 100° C. of 5200 Pa·s, contain THF insoluble matter in an amount of 2% by mass, and have a weight average molecular weight (Mw) of 17,000.

<Preparation of Aqueous Dispersion Liquid of Crystalline Polyester 1>

The crystalline polyester 1 (60 parts) and 60 parts of ethyl acetate were mixed at 60° C., to thereby obtain ethyl acetate solution of crystalline polyester 1.

Water (120 parts), 2 parts of an anionic surfactant (NEOGEN R, product of Dai-ichi Kogyo Seiyaku Co., Ltd.), and 2.4 parts of a 2% by mass aqueous sodium hydroxide were mixed, to thereby obtain an aqueous phase.

The ethyl acetate solution of crystalline polyester 1 (120 parts) was added to the obtained aqueous phase, followed by emulsifying by a homogenizer (ULTRA-TURRAX T50, product of IKA). Next, the resultant mixture was emulsified by a Manton Gaulin high-pressure homogenizer (product of Gaulin), to thereby obtain an emulsified slurry.

A container equipped with a stirrer and a thermometer was charged with the obtained emulsified slurry, followed by removing the solvent at 60° C. for 4 hours, to thereby obtain aqueous dispersion liquid of crystalline polyester 1. The aqueous dispersion liquid of crystalline polyester 1 was found to have a volume average particle diameter of 0.17 μm.

Note that, the volume average particle diameter of the aqueous dispersion liquid of crystalline polyester 1 was measured by a particle size distribution measuring apparatus (LA-920, product of HORIBA, Ltd.).

<Production of Toner 16>

A container equipped with a thermometer and a stirrer was charged with 207 parts of the aqueous dispersion liquid of non-crystalline polyester 7, 57 parts of the aqueous dispersion liquid of non-crystalline polyester 8, 28 parts of the aqueous dispersion liquid of crystalline polyester 1, 45 parts of the aqueous dispersion liquid of release agent 1, 34 parts of the aqueous dispersion liquid of colorant 1, and 600 parts of water, followed by stirring at 30° C. for 30 minutes. Next, a pH was adjusted to 10 with 2% by mass aqueous sodium hydroxide, followed by stirring by a homogenizer (ULTRA-TURRAX T50, product of IKA) at 5,000 rpm. Then, the resultant mixture was heated to 45° C., while 50 parts of 5% by mass aqueous magnesium chloride was gradually added dropwise thereto. The heated mixture was maintained until the particles were grown to have a volume average particle diameter of 5.0 μm, followed by cooled to 20° C., to thereby obtain slurry 16.

Toner 16 was obtained in the same manner as in the production of the toner 1 except that the slurry 1 was changed to the slurry 16. The toner 16 was found to have a melt viscosity ηt at 100° C. of 2700 Pa·s, contain THF insoluble matter in an amount of 2% by mass, and have a weight average molecular weight (Mw) of 17,200.

<Preparation of Master Batch 7>

Master batch 7 was obtained in the same manner as in the preparation of master batch 1 except that the non-crystalline polyester 1 was changed to the non-crystalline polyester 7.

<Preparation of Toner 17>

The non-crystalline polyester 7 (44 parts), 28 parts of the non-crystalline polyester 9, 6 parts of microcrystalline wax (HI-MIC-1090, product of NIPPON SEIRO CO., LTD.), and 12 parts of the master batch 7 were premixed by a Henschel mixer (HENSCHEL 20B, product of NIPPON COKE & ENGINEERING CO., LTD.) at 1,500 rpm for 3 minutes. Next, the resultant mixture was melt-kneaded by a small-sized Buss co-kneader (Buss Ltd.), which is an uniaxial kneader, under the conditions that a preset temperature of an inlet portion was set to 90° C., that a preset temperature of an outlet portion was set to 60° C., and that an amount of feed was set to 10 kg/h, followed by cooling and kneading. Moreover, the cooled and kneaded product was coarsely pulverized by a pulverizer (product of Hosokawa Micron Corporation), followed by finely pulverizing by a I-type mill IDS-2 type (product of Nippon Pneumatic Mfg. Co., Ltd.) under the conditions that an air pressure was 6.0 atm/cm$^2$, that an amount of feed was 0.5 kg/h, and that a plane-type impact plate was used. Then, the pulverized product was classified by a classfier (132MP, product of Alpine), to thereby obtain toner 17. The toner 17 was found to have a melt viscosity ηt at 100° C. of 7,700 Pa·s, contain THF insoluble matter in an amount of 8% by mass, and have a weight average molecular weight (Mw) of 21,970.

<Production of Toner 18>

The non-crystalline polyester 7 (42 parts), 25 parts of the non-crystalline polyester 9, 5 parts of the crystalline polyester 1, 6 parts of microcrystalline wax (HI-MIC-1090, product of NIPPON SEIRO CO., LTD.), and 12 parts of the master batch 7 were premixed by a Henschel mixer (HENSCHEL 20B, product of NIPPON COKE & ENGINEERING CO., LTD.) at 1,500 rpm for 3 minutes. Toner 18 was obtained in the same manner as in the production of toner 17 except that the premixture of the toner 17 was changed to the obtained premixture. The toner 18 was found to have a melt viscosity ηt at 100° C. of 5,800 Pa·s, contain THF insoluble matter in an amount of 8% by mass, and have a weight average molecular weight (Mw) of 21,080.

<Production of Toner 19>

—Preparation of Oil Phase 19—

A container equipped with a thermometer and a stirrer was charged with 108 parts of the non-crystalline polyester 1, 141 parts of the ethyl acetate dispersion liquid of crystalline polyester 1, 120 parts of the ethyl acetate dispersion liquid of release agent 1, and 20 parts of the master batch 1, followed by pre-dispersion by a stirrer. Next, the resultant mixture was stirred at 5,000 rpm by a TK homomixer (product of PRIMIX Corporation), to thereby obtain oil phase 19.

—Emulsifying or Dispersing—

A container was charged with 389 parts of the oil phase 19, 24 parts of the ethyl acetate solution of polyester prepolymer 1, and 3 parts of an isophoronediamine containing ethyl acetate solution in an amount of 50% by mass. Using a TK homomixer (product of PRIMIX Corporation), the resultant mixture was stirred at 5,000 rpm, to thereby obtain oil phase 19'.

A container equipped with a stirrer and a thermometer was charged with 590 parts of the aqueous phase 1, followed by stirring by a TK homomixer (product of PREMIX Corporation) at 13,000 rpm. During stirring, the oil phase 19' was added thereto, followed by emulsifying for 1 minute, to thereby obtain emulsified slurry 19.

Toner 19 was obtained in the same manner as in the production of toner 1 except that the emulsified slurry 1 was changed to the emulsified slurry 19. The toner 19 was found to have a melt viscosity ηt at 100° C. of 430 Pa·s, contain THF insoluble matter in an amount of 1% by mass, and has a weight average molecular weight (Mw) of 7,070.

<Production of Toner 20>

—Preparation of Oil Phase 20—

A container equipped with a thermometer and a stirrer was charged with 108 parts of the non-crystalline polyester 3, 120 parts of the ethyl acetate dispersion liquid of release agent 2, 20 parts of the master batch 3, and 60 parts of ethyl acetate, followed by pre-dispersion by a stirrer. Next, the resultant mixture was stirred at 5,000 rpm by a TK homomixer (product of PRIMIX Corporation), to thereby obtain oil phase 20.

—Emulsifying or Dispersing—

A container was charged with 308 parts of the oil phase 20, 64 parts of the ethyl acetate solution of polyester prepolymer 2, and 3 parts of an isophoronediamine containing ethyl acetate solution in an amount of 50% by mass. Using a TK homomixer (product of PRIMIX Corporation), the resultant mixture was stirred at 5,000 rpm, to thereby obtain oil phase 20'.

A container equipped with a stirrer and a thermometer was charged with 470 parts of the aqueous phase 1, followed by stirring by a TK homomixer (product of PRIMIX Corporation) at 13,000 rpm. During stirring, the oil phase 20' was added thereto, followed by emulsifying for 1 minute, to thereby obtain emulsified slurry 20.

Toner 20 was obtained in the same manner as in the production of toner 1 except that the emulsified slurry 1 was changed to the emulsified slurry 20. The toner 20 was found to have a melt viscosity ηt at 100° C. of 9,000 Pa·s, contain THF insoluble matter in an amount of 14% by mass, and have a weight average molecular weight (Mw) of 16,340.

<Production of Toner 21>

—Preparation of Oil Phase 21—

A container equipped with a thermometer and a stirrer was charged with 108 parts of the non-crystalline polyester 3, 80 parts of the ethyl acetate dispersion liquid of crystalline polyester 1, 120 parts of the ethyl acetate dispersion liquid of release agent 4, and 20 parts of the master batch 3, followed by pre-dispersion by a stirrer. Next, the resultant mixture was stirred at 5,000 rpm by a TK homomixer (product of PRIMIX Corporation), to thereby obtain oil phase 21.

—Emulsifying or Dispersing—

A container was charged with 328 parts of the oil phase 21, 50 parts of the ethyl acetate solution of polyester prepolymer 3, and 3 parts of an isophoronediamine containing ethyl acetate solution in an amount of 50% by mass. Using a TK homomixer (product of PRIMIX Corporation), the resultant mixture was stirred at 5,000 rpm, to thereby obtain oil phase 21'.

A container equipped with a stirrer and a thermometer was charged with 500 parts of the aqueous phase 1, followed by stirring by a TK homomixer (product of PREMIX Corporation) at 13,000 rpm. During stirring, the oil phase 21' was added thereto, followed by emulsifying for 1 minute, to thereby obtain emulsified slurry 21.

Toner 21 was obtained in the same manner as in the production of toner 1 except that the emulsified slurry 1 was changed to the emulsified slurry 21. The toner 21 was found to have a melt viscosity ηt at 100° C. of 1,200 Pa·s, contain THF insoluble matter in an amount of 9% by mass, and have a weight average molecular weight (Mw) of 11,800.

<Production of Toner 22>

Toner 22 was obtained in the same manner as in the production of toner 21 except that the ethyl acetate dispersion liquid of release agent 4 was changed to the ethyl acetate dispersion liquid of release agent 5. The toner 22 was found to have a melt viscosity ηt at 100° C. of 1,800 Pa·s, contain THF insoluble matter in an amount of 9% by mass, and have a weight average molecular weight (Mw) of 11,400.

<Production of Toner 23>

Toner 23 was obtained in the same manner as in the production of toner 21 except that the ethyl acetate dispersion liquid of release agent 4 was changed to the ethyl acetate dispersion liquid of release agent 6. The toner 23 was found to have a melt viscosity ηt at 100° C. of 1,600 Pa·s, contain THF insoluble matter in an amount of 9% by mass, and have a weight average molecular weight (Mw) of 11,000.

<Production of Toner 24>

Toner 24 was obtained in the same manner as in the production of toner 21 except that the ethyl acetate dispersion liquid of release agent 4 was changed to the ethyl acetate dispersion liquid of release agent 7. The toner 24 was found to have a melt viscosity ηt at 100° C. of 1,100 Pa·s, contain THF insoluble matter in an amount of 9% by mass, and have a weight average molecular weight (Mw) of 9,000.

<Production of Toner 25>

Toner 25 was obtained in the same manner as in the production of toner 21 except that the ethyl acetate dispersion liquid of release agent 4 was changed to the ethyl acetate dispersion liquid of release agent 8. The toner 25 was found to have a melt viscosity ηt at 100° C. of 2,000 Pa·s, contain THF insoluble matter in an amount of 9% by mass, and have a weight average molecular weight (Mw) of 13,000.

<Production of Toner 26>

Toner 26 was obtained in the same manner as in the production of toner 21 except that the ethyl acetate dispersion liquid of release agent 4 was changed to the ethyl acetate dispersion liquid of release agent 9. The toner 26 was found to have a melt viscosity ηt at 100° C. of 2,300 Pa·s, contain THF insoluble matter in an amount of 9% by mass, and have a weight average molecular weight (Mw) of 13,000.

Production methods and materials for preparations of toners 1 to 26 are shown in Table 2.

TABLE 2

| Toners | Production methods | Non-crystalline polyester | Non-crystalline polyester | Crystalline polyester | Release agent | Polyester prepolymer |
|---|---|---|---|---|---|---|
| 1 | Ester extension method | 1 | — | 1 | 1 | 1 |
| 2 | Ester extension method | 2 | — | — | 2 | 2 |
| 3 | Ester extension method | 3 | — | 1 | 3 | 3 |
| 4 | Ester extension method | 3 | — | 1 | 2 | 3 |
| 5 | Ester extension method | 3 | — | 1 | 1 | 3 |
| 6 | Ester extension method | 2 | — | 1 | 1 | 3 |
| 7 | Ester extension method | 2 | — | 1 | 2 | 3 |
| 8 | Ester extension method | 4 | — | 1 | 1 | 2 |
| 9 | Ester extension method | 1 | — | 1 | 1 | 4 |
| 10 | Ester extension method | 5 | — | 1 | 2 | 2 |
| 11 | Ester extension method | 6 | — | 1 | 3 | 4 |
| 12 | Ester extension method | 3 | — | 1 | 1 | 3 |
| 13 | Dissolution suspension method | 2 | 8 | — | 1 | — |
| 14 | Dissolution suspension method | 2 | 8 | 1 | 1 | — |
| 15 | Emulsion aggregation method | 7 | 8 | — | 1 | — |
| 16 | Emulsion aggregation method | 7 | 8 | 1 | 1 | — |
| 17 | Pulverizing method | 7 | 9 | — | 1 | — |
| 18 | Pulverizing method | 7 | 9 | 1 | 1 | — |
| 19 | Ester extension method | 1 | — | 1 | 1 | 1 |
| 20 | Ester extension method | 3 | — | — | 2 | 2 |
| 21 | Ester extension method | 3 | — | 1 | 4 | 3 |
| 22 | Ester extension method | 3 | — | 1 | 5 | 3 |
| 23 | Ester extension method | 3 | — | 1 | 6 | 3 |
| 24 | Ester extension method | 3 | — | 1 | 7 | 3 |

TABLE 2-continued

| Toners | Production methods | Non-crystalline polyester | Non-crystalline polyester | Crystalline polyester | Release agent | Polyester prepolymer |
|---|---|---|---|---|---|---|
| 25 | Ester extension method | 3 | — | 1 | 8 | 3 |
| 26 | Ester extension method | 3 | — | 1 | 9 | 3 |

Physical properties of the toners 1 to 26 are shown in Table 3.

TABLE 3

| Toners | ηt [mPa · s] | Amount of THF insoluble matter [% by mass] | Mw |
|---|---|---|---|
| 1 | 920 | 3 | 7,560 |
| 2 | 7,200 | 11 | 13,570 |
| 3 | 2,300 | 9 | 11,200 |
| 4 | 2,800 | 9 | 11,390 |
| 5 | 2,500 | 9 | 11,600 |
| 6 | 6,900 | 10 | 10,830 |
| 7 | 7,400 | 12 | 11,550 |
| 8 | 7,600 | 13 | 17,840 |
| 9 | 700 | 1 | 5,810 |
| 10 | 7,900 | 15 | 20,290 |
| 11 | 550 | 1 | 4,715 |
| 12 | 2,400 | 9 | 11,330 |
| 13 | 4,300 | 2 | 7,960 |
| 14 | 2,000 | 2 | 8,960 |
| 15 | 5,200 | 2 | 17,000 |
| 16 | 2,700 | 2 | 17,200 |
| 17 | 7,700 | 8 | 21,970 |
| 18 | 5,800 | 8 | 21,080 |
| 19 | 430 | 1 | 7,070 |
| 20 | 9,000 | 14 | 16,340 |
| 21 | 1,200 | 9 | 11,800 |
| 22 | 1,800 | 9 | 11,400 |
| 23 | 1,600 | 9 | 11,000 |
| 24 | 1,100 | 9 | 9,000 |
| 25 | 2,000 | 9 | 13,000 |
| 26 | 2,300 | 9 | 13,000 |

<Melt Viscosity ηt at 100° C.>

First, 1 g of the toner was pressed by a molding apparatus, to thereby prepare pellets. Next, the prepared pellets were set to an elevated flow tester (CFT500 type, product of SIAIMADZU CORPORATION), and were measured under the following conditions. A viscosity at 100° C. was determined to as melt viscosity ηT at 100° C.

Caliber of die: 0.50 mm

Length of die: 1.0 mm

Measuring temperature: 40° C. to 200° C.

Heating rate: 3.0° C./min

Test load: 30 kgf

Stroke: 8.0 mm

<Amount of THF Insoluble Matter>

A toner (3 g) was weighed and a value thereof was determined as "A [g]". Next, the weighed toner was charged into a thimble having an inner diameter of 24 mm (mass of the thimble was measured in advance), the thimble was set to an extraction tube, and then, 200 mL of tetrahydrofuran (THF) was charged into a flask equipped with a condenser. Then, the flask portion was charged into a mantle heater, and THF was allowed to reflux at 60° C. for 8 hours. Next, THF was distilled under reduced pressure. As a result, a residue remaining in the thimble (THF insoluble matter) was weighed, and a value thereof was determined as B [g]. The aforementioned measurement was conducted three times, and then, the obtained three measurements for values A and B were averaged to obtain the values A and B. Thus, the values A and B were used for calculation of an amount of THF insoluble matter [% by mass] by the following expression.

$$(B/A)\times 100$$

<Weight Average Molecular Weight Mw>

Weight average molecular weight Mw was measured by gel permeation chromatography (GPC). Specifically, a column was stabilized in a heat chamber of 40° C., and then, THF, serving as a solvent was poured to the chamber at a flow velocity of 1 mL/min. A toner containing THF solution in an adjusted amount of 0.05% by mass to 0.6% by mass (50 μL to 200 μL) was charged into the chamber, followed by measuring the weight average molecular weight. At this time, the weight average molecular weight was calculated based on a relationship between the logarithmic value and the count number of a calibration curve given by using several monodisperse polystyrene-standard samples. Polystyrene-standard samples having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$ (products of Pressure Chemical Co., or TOSOH CORPORATION), were used in order to prepare the calibration curve. A RI (refractive index) detector was used as a detector.

<Preparation of Carrier>

Silicone resin containing solution (SR2410, product of Dow Corning Toray Co., Ltd.) having a solid content in an amount of 23% by mass (26 parts), 2.5 parts of an acrylic resin (HITALOID 3001, product of Dow Corning Toray Co., Ltd.) having a solid content in an amount of 50% by mass, 5 parts of a benzoguanamine resin (MYCOAT, product of Mitsui Cytec, Ltd.) having a solid content of 77% by mass, 18 parts of alumina particles having an average primary particle size of 0.3 μm and specific electrical resistance of $1\times10^{14}$ Ω·cm, 2 parts of a catalyst (TC-750, titanium diisopropoxybis (ethyl acetoacetate)) (product of Matsumoto Fine Chemical Co. Ltd.), and 0.2 parts of a silane coupling agent (SH6020, product of Dow Corning Toray Co., Ltd.) were diluted with toluene, followed by dispersing by a homomixer for 10 minutes, to thereby obtain a coating liquid for protective layer having a solid content in an amount of 10% by mass.

The coating liquid for protective layer was applied to fired ferrite particles ($(MgO)_{1.8}(MnO)_{49.5}(Fe_2O_3)_{48.0}$) using SPIRA COTA (OKADA SEIKO CO., LTD.) so that a thickness of the protective layer was 0.15 μm, followed by drying, to thereby form a protective layer. Then, the resultant product was fired by an electric furnace for 2 hours at 180° C., and was cooled. The resultant product was beaten by a sieve with a mesh size of 106 μm, to thereby obtain a carrier having a weight average particle diameter of 35 μm.

<Specific Electrical Resistance>

A specific electrical resistance was measured by a powder resistivity measuring system (MCP-PD51, product of Diane Instruments) and a resistivity meter (LORESTA GP, product of Mitsubishi Chemical Analytech Co., Ltd.), which is based on 4-terminal and 4-point probe method under the following conditions.

Sample: 1.0 g

Interval between electrodes: 3 mm

Radius of sample: 10.0 mm

Load: 20 kN

<Weight Average Particle Diameter>

Weight average particle diameter was measured by a Micro Track particle size distribution meter (HRA 9320-X100, product of Honewell) under the following conditions.

Diameter range: 8 μm to 100 μm

Channel length (channel width): 2 μm

Number of channels: 46

Refractive index: 2.42

Note that, when weight average particle diameter was calculated, a lower limit of the particle diameter in each of the channels was used as a typical particle size.

Example 1

A commercially available ointment bottle was charged with 70 parts of the toner 1 and 930 parts of the carrier, followed by mixing by a Turbula mixer at 81 rpm for 5 minutes, to thereby obtain a developer.

The obtained developer was set in the image forming apparatus. At this time, a fixing roller containing a release layer made of PFA (perfluoro alkoxy fluororesin) and formed on a surface which contacts the toner image transferred onto recording media as a fixing member. A receding contact angle θc1 of the release agent with respect to the release layer was found to be 55°, and a receding contact angle θc2 of the release agent with respect to the toner was found to be 30°.

Example 2

The obtained developer was set in the image forming apparatus in the same manner as in Example 1 except that the toner 1 was changed to the toner 2. At this time, a receding contact angle θc1 of the release agent with respect to the release layer was found to be 49°, and a receding contact angle θc2 of the release agent with respect to the toner was found to be 38°.

Example 3

The obtained developer was set in the image forming apparatus in the same manner as in Example 1 except that the toner 1 was changed to the toner 3. At this time, the receding contact angle θc1 of the release agent with respect to a release layer was found to be 52°, and a receding contact angle θc2 of the release agent with respect to the toner was found to be 35°.

Example 4

The obtained developer was set in the image forming apparatus in the same manner as in Example 1 except that the toner 1 was changed to the toner 4. At this time, a receding contact angle θc1 of the release agent with respect to the release layer was found to be 49°, and a receding contact angle θc2 of the release agent with respect to the toner was found to be 35°.

Example 5

The obtained developer was set in the image forming apparatus in the same manner as in Example 1 except that the toner 1 was changed to the toner 12; and the fixing roller of Example 1 was changed to a fixing roller containing a release layer made of ETFE (ethylene.tetrafluoroethylene copolymer) and formed on a surface which contacts the toner image transferred onto recording media as a fixing member. At this time, a receding contact angle θc1 of the release agent with respect to the release layer was found to be 47°, and a receding contact angle θc2 of the release agent with respect to the toner was found to be 35°.

Example 6

The obtained developer was set in the image forming apparatus in the same manner as in Example 1 except that the toner 1 was changed to the toner 25. At this time, a receding contact angle θc1 of the release agent with respect to the release layer was found to be 59°, and a receding contact angle θc2 of the release agent with respect to the toner was found to be 35°.

Example 7

The obtained developer was set in the image forming apparatus in the same manner as in Example 1 except that the toner 1 was changed to the toner 26. At this time, a receding contact angle θc1 of the release agent with respect to the release layer was found to be 48°, and a receding contact angle θc2 of the release agent with respect to the toner was found to be 38°.

Example 8

The obtained developer was set in the image forming apparatus in the same manner as in Example 1 except that the toner 1 was changed to the toner 6. At this time, a receding contact angle θc1 of the release agent with respect to the release layer was found to be 55°, and a receding contact angle θc2 of the release agent with respect to the toner was found to be 36°.

Example 9

The obtained developer was set in the image forming apparatus in the same manner as in Example 1 except that the toner 1 was changed to the toner 7. At this time, a receding contact angle θc1 of the release agent with respect to the release layer was found to be 49°, and a receding contact angle θc2 of the release agent with respect to the toner was found to be 38°.

Example 10

The obtained developer was set in the image forming apparatus in the same manner as in Example 1 except that the toner 1 was changed to the toner 8. At this time, a receding contact angle θc1 of the release agent with respect to the release layer was found to be 55°, and a receding contact angle θc2 of the release agent with respect to the toner was found to be 38°.

Example 11

The obtained developer was set in the image forming apparatus in the same manner as in Example 1 except that the toner 1 was changed to the toner 9. At this time, a receding contact angle θc1 of the release agent with respect to the release layer was found to be 55°, and a receding contact angle θc2 of the release agent with respect to the toner was found to be 29°.

Example 12

The obtained developer was set in the image forming apparatus in the same manner as in Example 1 except that the toner 1 was changed to the toner 10. At this time, a receding contact angle θc1 of the release agent with respect to the release layer was found to be 49°, and a receding contact angle θc2 of the release agent with respect to the toner was found to be 37°.

Example 13

The obtained developer was set in the image forming apparatus in the same manner as in Example 1 except that the toner 1 was changed to the toner 11. At this time, a receding contact angle θc1 of the release agent with respect to the release layer was found to be 52°, and a receding contact angle θc2 of the release agent with respect to the toner was found to be 29°.

Example 14

The obtained developer was set in the image forming apparatus in the same manner as in Example 1 except that the toner 1 was changed to the toner 12. At this time, a receding contact angle θc1 of the release agent with respect to the release layer was found to be 55°, and a receding contact angle θc2 of the release agent with respect to the toner was found to be 35°.

Example 15

The obtained developer was set in the image forming apparatus in the same manner as in Example 1 except that the toner 1 was changed to the toner 13. At this time, a receding contact angle θc1 of the release agent with respect to the release layer was found to be 55°, and a receding contact angle θc2 of the release agent with respect to the toner was found to be 30°.

Example 16

The obtained developer was set in the image forming apparatus in the same manner as in Example 1 except that the toner 1 was changed to the toner 14. At this time, a receding contact angle θc1 of the release agent with respect to the release layer was found to be 55°, and a receding contact angle θc2 of the release agent with respect to the toner was found to be 30°.

Example 17

The obtained developer was set in the image forming apparatus in the same manner as in Example 1 except that the toner 1 was changed to the toner 15. At this time, a receding contact angle θc1 of the release agent with respect to the release layer was found to be 55°, and a receding contact angle θc2 of the release agent with respect to the toner was found to be 30°.

Example 18

The obtained developer was set in the image forming apparatus in the same manner as in Example 1 except that the toner 1 was changed to the toner 16. At this time, a receding contact angle θc1 of the release agent with respect to the release layer was found to be 55°, and a receding contact angle θc2 of the release agent with respect to the toner was found to be 30°.

Example 19

The obtained developer was set in the image forming apparatus in the same manner as in Example 1 except that the toner 1 was changed to the toner 17. At this time, a receding contact angle θc1 of the release agent with respect to the release layer was found to be 55°, and a receding contact angle θc2 of the release agent with respect to the toner was found to be 35°.

Example 20

The obtained developer was set in the image forming apparatus in the same manner as in Example 1 except that the toner 1 was changed to the toner 18. At this time, a receding contact angle θc1 of the release agent with respect to the release layer was found to be 55°, and a receding contact angle θc2 of the release agent with respect to the toner was found to be 35°.

Comparative Example 1

The obtained developer was set in the image forming apparatus in the same manner as in Example 1 except that the toner 1 was changed to the toner 19. At this time, a receding contact angle θc1 of the release agent with respect to the release layer was found to be 55°, and a receding contact angle θc2 of the release agent with respect to the toner was found to be 29°.

Comparative Example 2

The obtained developer was set in the image forming apparatus in the same manner as in Example 1 except that the toner 1 was changed to the toner 20. At this time, a receding contact angle θc1 of the release agent with respect to the release layer was found to be 49°, and a receding contact angle θc2 of the release agent with respect to the toner was found to be 39°.

Comparative Example 3

The obtained developer was set in the image forming apparatus in the same manner as in Example 1 except that the toner 1 was changed to the toner 21. At this time, a receding contact angle θc1 of the release agent with respect to the release layer was found to be 46°, and a receding contact angle θc2 of the release agent with respect to the toner was found to be 35°.

Comparative Example 4

The obtained developer was set in the image forming apparatus in the same manner as in Example 1 except that the toner 1 was changed to the toner 22. At this time, a receding contact angle θc1 of the release agent with respect to the release layer was found to be 50°, and a receding contact angle θc2 of the release agent with respect to the toner was found to be 35°.

Comparative Example 5

The obtained developer was set in the image forming apparatus in the same manner as in Example 5 except that the toner 12 was changed to the toner 23 At this time, a receding contact angle θc1 of the release agent with respect to the release layer was found to be 43°, and a receding contact angle θc2 of the release agent with respect to the toner was found to be 35°.

Comparative Example 6

The obtained developer was set in the image forming apparatus in the same manner as in Example 1 except that the toner 1 was changed to the toner 24. At this time, a receding contact angle θc1 of the release agent with respect to the release layer was found to be 62°, and a receding contact angle θc2 of the release agent with respect to the toner was found to be 35°.

Comparative Example 7

The obtained developer was set in the image forming apparatus in the same manner as in Example 5 except that the toner 12 was changed to the toner 26. At this time, a receding contact angle θc1 of the release agent with respect to the release layer was found to be 46°, and a receding contact angle θc2 of the release agent with respect to the toner was found to be 38°.

Properties of the image forming apparatus in Examples 1 to 20 and Comparative Examples 1 to 7 are shown in FIG. 4.

TABLE 4

| | Toners | Release layer of fixing members | θc1 [°] | θc2 [°] | θc1-θc2 [°] |
|---|---|---|---|---|---|
| Example 1 | 1 | PFA | 55 | 30 | 25 |
| Example 2 | 2 | PFA | 49 | 38 | 11 |
| Example 3 | 3 | PFA | 52 | 35 | 17 |
| Example 4 | 4 | PFA | 49 | 35 | 14 |
| Example 5 | 12 | ETFE | 47 | 35 | 12 |
| Example 6 | 25 | PFA | 59 | 35 | 24 |
| Example 7 | 26 | PFA | 48 | 38 | 10 |
| Example 8 | 6 | PFA | 55 | 36 | 19 |
| Example 9 | 7 | PFA | 49 | 38 | 11 |
| Example 10 | 8 | PFA | 55 | 38 | 17 |
| Example 11 | 9 | PFA | 55 | 29 | 26 |
| Example 12 | 10 | PFA | 49 | 37 | 12 |
| Example 13 | 11 | PFA | 52 | 29 | 23 |
| Example 14 | 12 | PFA | 55 | 35 | 20 |
| Example 15 | 13 | PFA | 55 | 30 | 25 |
| Example 16 | 14 | PFA | 55 | 30 | 25 |
| Example 17 | 15 | PFA | 55 | 30 | 25 |
| Example 18 | 16 | PFA | 55 | 30 | 25 |
| Example 19 | 17 | PFA | 55 | 35 | 20 |
| Example 20 | 18 | PFA | 55 | 35 | 20 |
| Comparative Example 1 | 19 | PFA | 55 | 29 | 26 |
| Comparative Example 2 | 20 | PFA | 49 | 39 | 10 |
| Comparative Example 3 | 21 | PFA | 46 | 35 | 11 |
| Comparative Example 4 | 22 | PFA | 50 | 35 | 15 |
| Comparative Example 5 | 23 | ETFE | 43 | 35 | 8 |
| Comparative Example 6 | 24 | PFA | 62 | 35 | 27 |
| Comparative Example 7 | 26 | ETFE | 46 | 38 | 8 |

<Receding Contact Angle θc1>

Receding contact angle θc1 was measured using a contact angle measuring device (DROP MASTER DM500, product of Kyowa Interface Science Co., Ltd). Specifically, a syringe holder was charged with a release agent, a heating temperature of the syringe was set to 145° C., and the release agent was allowed to react. Next, in a state that a fixing member taken out from the image forming apparatus was heated by an external heating device so that the surface temperature of the release layer was 150° C., a liquid containing the release agent melted therein was put on the surface of the release agent using the syringe holder, to thereby form a droplet thereof. Then, the droplet was sucked, the release agent melting liquid was put thereon, and the receding contact angle was measured three times. The obtained measurements were averaged to thereby be determined as θc1.

<Receding Contact Angle θc2>

Receding contact angle θc2 was measured using a contact angle measuring device (DROP MASTER DM500, product of Kyowa Interface Science Co., Ltd.). Specifically, a syringe holder was charged with a release agent, a heating temperature of the syringe was set to 145° C., and the release agent was allowed to react. Next, in a state that a fixed image formed by an image forming apparatus was heated on a heating stage so that the surface temperature thereof was 150° C., a liquid containing the release agent melted therein was put on the surface of the fixed image using the syringe holder, to thereby form a droplet thereof. Then, the droplet was sucked, the release agent melting liquid was put thereon, and the receding contact angle was measured three times. The obtained three measurements in three times were averaged to thereby be determined as θc2.

Low temperature fixing ability, gloss afterimage and separability were evaluated by using the image forming apparatuses of Examples 1 to 20 and Comparative Examples 1 to 7.

<Low Temperature Fixing Ability>

A chart having a size of 3 cm×10 cm was formed by an image forming apparatus on copying paper (TYPE 6000<70 W>, product of Ricoh Company, Ltd.), and then, low temperature fixing ability was evaluated. Specifically, the toner was deposited in an amount of 0.85±0.05 mg/cm$^2$ under the following conditions: the paper-feeding linear velocity of 260 mm/s to 280 mm/s, the surface pressure of 1.2 kgf/cm$^2$, and the nip width of 11 mm. The toner was allowed to fix by changing a fixing temperature, to thereby determine a minimum fixing temperature. Note that, the results were judged based on the following criteria.

A: The minimum fixing temperature is less than 120° C.

B: The minimum fixing temperature is 120° C. or more but less than 130° C.

C: The minimum fixing temperature is 130° C. or more but less than 140° C.

D: The minimum fixing temperature is 140° C. or more.

<Gloss Afterimage>

Figure 6A:
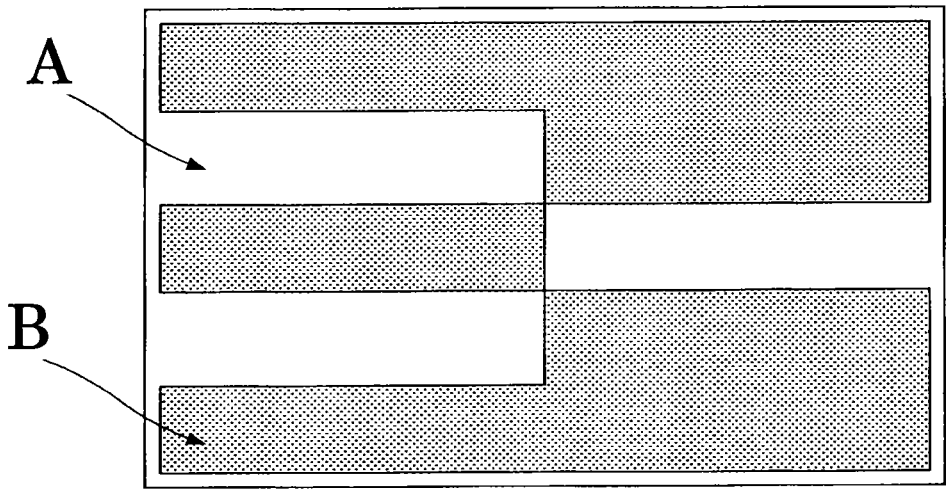
FIG. 6A illustrates an evaluation chart used for evaluation of a gloss afterimage.
Figure 6B:
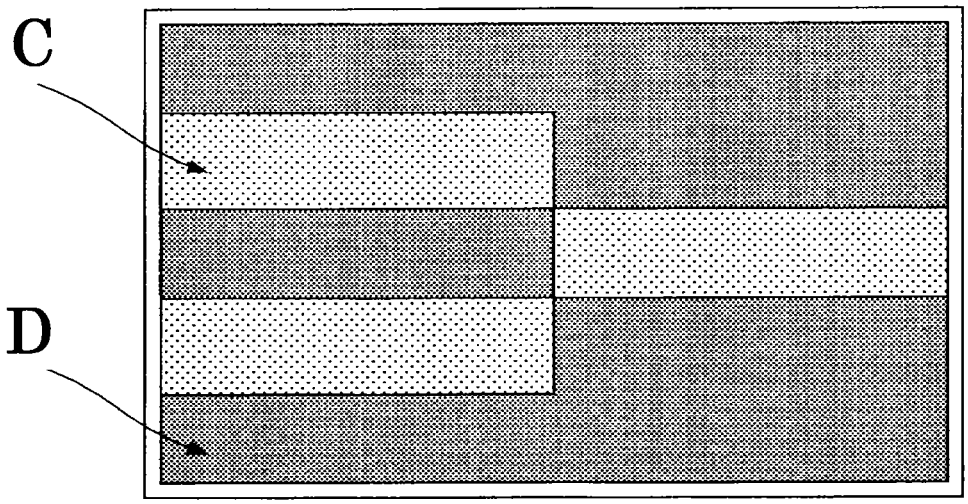
FIG. 6B illustrates a solid image.

The toner was deposited in an amount of 1.00±0.02 mg/cm$^2$ using an image forming apparatus on paper of MONDI COLOR COPY 300 (product of month) having a weighing of 300 g/m$^2$, and then, an evaluation chart and a solid image (refer to FIG. 6A and FIG. 6B) were consecutively formed. In FIG. 6A, the arrow "A" means a non-image area, and the arrow "B" means a image-area. At this time, the toner was allowed to fix by changing a fixing temperature under the following conditions: the paper-feeding linear velocity of 415 mm/s, the surface pressure of 1.6 kgf/cm$^2$, and the nip width of 20 mm, and then, gloss afterimage was evaluated by using the solid image at each of the fixing temperatures. Specifically, a 60 degree-glossiness was measured in any three portions of each of the evaluation portion (1) (low glossiness) (the arrow C in FIG. 6B) and the evaluation portion (2) (high glossiness) (the arrow D in FIG. 6B) using a gloss meter (VG-7000, product of NIPPON DENSHOKU INDUSTRIES CO., LTD.). Then, each of the average glossiness was calculated and a fixing temperature at which a difference in average glossiness between (1) and (2) was 20% or more was determined. Note that, the results were judged based on the following evaluation criteria.

A: The fixing temperature at which the difference in average glossiness between (1) and (2) is 20% or more, is 190° C. or more; or the difference in average glossiness between (1) and (2) is not 20% or more.

B: The fixing temperature at which the difference in average glossiness between (1) and (2) is 20% or more, is 180° C. or more but less than 190° C.

C: The fixing temperature at which the difference in average glossiness between (1) and (2) is 20% or more, is 170° C. or more but less than 180° C.

D: The fixing temperature at which the difference in average glossiness between (1) and (2) is 20% or more, is less than 170° C.

<Separability>

A force required to peal off a recording medium from a fixing roller (i.e., separation resistance force) was measured by a measuring device for pressing force of recording medium 1 (refer to FIG. 5), and separability was evaluated.

In the measuring device for pressing force of recording medium 1, a recording medium S is pressed by a measuring pawl 2, and then, is conveyed. At this time, pressing force of the recording medium is read by a load cell 4 configured to mount on the other end of the measuring pawl 2 through a fulcrum 3. A value read by the load cell 4 is separation resistance force. The measuring pawl 2 is configured to be mounted on a side of a fixing roller 5 which is just behind a nip portion 7 configured to be mounted on between a fixing roller 5 and a pressure roller 6.

At this time, the measuring device for pressing force of recording medium 1 was fixed on a fixing part of the image forming apparatus so that the measuring pawl 2 was properly disposed using a fixture. Also, as the recording medium S, the toner was deposited in an amount of 0.85±0.01 mg/cm$^2$ on A4 paper (TYPE 6200, product of Ricoh Company, Ltd.) and then, 3 mm×3 mm of an unfixed solid image was formed on the area at which is a central part of 2 cm from the upper end and is from right and left. The separation resistance force generated during fixing at a fixing temperature of 160° C. was measured. Note that, the results were judged based on the following evaluation criteria.

A: The separation resistance force is less than 200 gf.

B: The separation resistance force is 200 gf or more but less than 300 gf.

C: The separation resistance force is 300 gf or more but less than 400 gf.

D: The separation resistance force is 400 gf or more.

Figure 5:
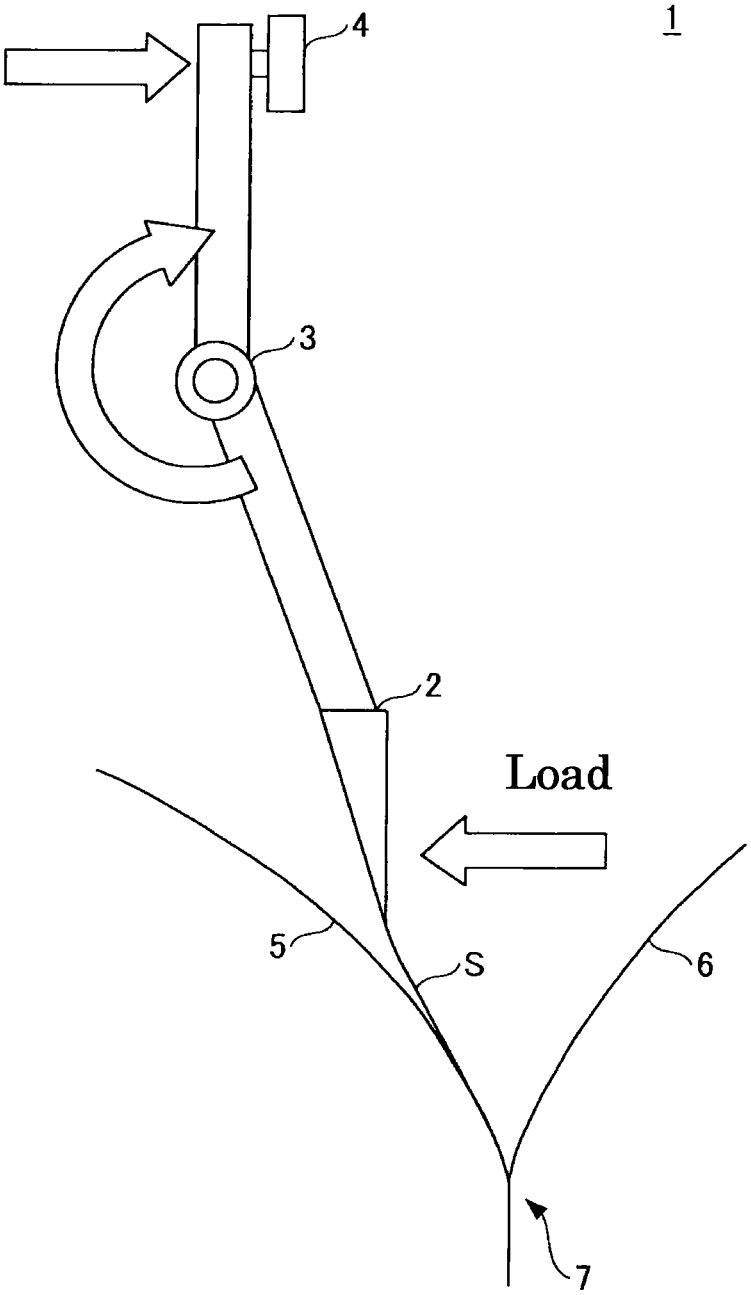
FIG. 5 is a schematic view of a measuring device for measuring a pressing force against a recording medium.

Evaluation results of the image forming apparatuses of Examples 1 to 20 and Comparative Examples 1 to 7 in low temperature fixing ability, gloss afterimage, and separability are shown in FIG. 5.

TABLE 5

| | Low temperature fixing ability | Gloss afterimage | Separability |
|---|---|---|---|
| Example 1 | A | B | C |
| Example 2 | C | B | A |
| Example 3 | B | B | A |
| Example 4 | B | B | C |
| Example 5 | A | B | A |
| Example 6 | A | A | A |
| Example 7 | A | B | A |
| Example 8 | B | A | A |
| Example 9 | C | B | A |
| Example 10 | B | A | A |
| Example 11 | A | C | C |
| Example 12 | C | B | A |
| Example 13 | A | C | C |
| Example 14 | A | A | A |
| Example 15 | B | A | A |
| Example 16 | A | A | A |
| Example 17 | B | A | A |
| Example 18 | A | A | A |
| Example 19 | C | B | A |
| Example 20 | B | B | A |
| Comparative Example 1 | A | C | D |
| Comparative Example 2 | D | B | B |
| Comparative Example 3 | D | D | B |
| Comparative Example 4 | C | B | D |
| Comparative Example 5 | D | D | A |
| Comparative Example 6 | D | D | D |
| Comparative Example 7 | A | D | B |

With reference to Table 5, the image forming apparatuses of Examples 1 to 20 are observed that the resultant toner is excellent in low temperature fixing ability and separability, and can inhibit the toner from forming gloss afterimage.

Meanwhile, in the image forming apparatus of Comparative Example 1, the toner 19 is 430 Pa·s in a and thus, separability of the toner is deteriorated.

In the image forming apparatus of Comparative Example 2, the toner 20 is 9,000 Pa·s in ηt, and thus, low temperature fixing ability of the toner is deteriorated.

In the image forming apparatus of Comparative Example 3, since the release agent 4 is 17 mPa·s in ηw, low temperature fixing ability of the toner is deteriorated, and gloss afterimage is formed.

In image forming apparatus of Comparative Example 4, the release agent 5 is 31 mPa·s in ηw, and thus, separability of the toner is deteriorated.

The image forming apparatus of Comparative Example 5 is 43° in θc1, is 8° in θc1-θc2, and the release agent 6 is 7 mPa·s in ηw, and thus, low temperature fixing ability of the toner is deteriorated and gloss afterimage is formed.

The image forming apparatus of Comparative Example 6 is 62° in θc1, and the release agent 7 is 5 mPa·s in ηw, and thus, low temperature fixing ability and separability of the toner are deteriorated, and gloss afterimage is formed.

The image forming apparatus of Comparative Example 7 is 8° in θc1-θc2, and thus, gloss afterimage is formed.

This application claims priority to Japanese application No. 2014-053942, filed on Mar. 17, 2014 and incorporated herein by reference.

What is claimed is:

1. An image forming apparatus, comprising:

a photoconductor;

a charging unit configured to charge the photoconductor;

an exposing unit configured to expose the charged photoconductor to light to form an electrostatic latent image;

a developing unit containing a toner and configured to develop the electrostatic latent image formed on the photoconductor with the toner to form a toner image;

a transfer unit configured to transfer the toner image formed on the photoconductor onto a recording medium; and a fixing unit configured to fix the toner image transferred on the recording medium, wherein the toner comprises an external additive and base particles containing a binder resin, a colorant, and a release agent, wherein the toner has a melt viscosity at 100° C. of 500 Pa·s to 8,000 Pa·s, wherein the release agent has a melt viscosity at 100° C. of 20 mPa·s to 30 mPa·s, wherein the fixing unit comprises a fixing member that has a roller shape or a belt shape and contacts the toner image transferred onto the recording medium, wherein the fixing member comprises a release layer on a surface thereof that is to be brought into contact with the toner image transferred onto the recording medium, and wherein the release layer satisfies the following expressions:

$$45 \leq \theta c1 \leq 60, \text{ and}$$

$$10 \leq \theta c1 - \theta c2,$$

where θc1 denotes a receding contact angle [°] of the release agent with respect to the release layer and θc2 denotes a receding contact angle [°] of the release agent with respect to the toner.

2. The image forming apparatus according to claim 1, wherein the binder resin comprises polyester.

3. The image forming apparatus according to claim 1, wherein tetrahydrofuran insoluble matter of the toner is 10% by mass or less.

4. The image forming apparatus according to claim 1, wherein a weight average molecular weight of the toner is 5,000 to 18,000.

5. The image forming apparatus according to claim 1, wherein the binder resin comprises a crystalline polyester.

6. The image forming apparatus according to claim 1, wherein an onset temperature of an endothermic peak in the lowest temperature side in differential scanning calorimetry analysis of the release agent is 50° C. or higher.

* * * * *